US007980967B2

(12) United States Patent
Cucjen et al.

(10) Patent No.: US 7,980,967 B2
(45) Date of Patent: Jul. 19, 2011

(54) PROGRAMMABLE BALL THROWING APPARATUS

(75) Inventors: Romulo J. Cucjen, Shreveport, LA (US); Dennis Randall Duron, Shreveport, LA (US)

(73) Assignee: Precision Sports Robotics, LLC, Shreveport, LA (US)

( * ) Notice: Subject to any disclaimer, the term of this patent is extended or adjusted under 35 U.S.C. 154(b) by 393 days.

(21) Appl. No.: 11/345,114

(22) Filed: Jan. 31, 2006

(65) Prior Publication Data

US 2006/0118096 A1 Jun. 8, 2006

Related U.S. Application Data

(63) Continuation of application No. 10/973,395, filed on Oct. 27, 2004, now Pat. No. 7,691,012.

(60) Provisional application No. 60/516,396, filed on Nov. 3, 2003.

(51) Int. Cl.
*A63B 67/00* (2006.01)

(52) U.S. Cl. ..... 473/422

(58) Field of Classification Search ..... 473/422, 473/421, 416; 273/26, 29
See application file for complete search history.

(56) References Cited

U.S. PATENT DOCUMENTS

| | | | | | |
|---|---|---|---|---|---|
| 4,077,386 | A | | 3/1978 | Berliner | |
| 4,116,192 | A | | 9/1978 | Scott | |
| 4,299,383 | A | * | 11/1981 | Yuasa | 473/436 |
| 4,325,351 | A | | 4/1982 | Yuasa | |
| 4,442,823 | A | * | 4/1984 | Floyd et al. | 124/78 |
| 4,702,475 | A | | 10/1987 | Elstein et al. | |
| 4,760,835 | A | | 8/1988 | Paulson et al. | |
| 4,844,548 | A | | 7/1989 | Masovich et al. | |
| 4,854,588 | A | | 8/1989 | Gatchel et al. | |
| 5,107,820 | A | | 4/1992 | Salansky | |
| 5,125,653 | A | | 6/1992 | Kovacs et al. | |
| 5,464,208 | A | | 11/1995 | Pierce | |
| 5,465,208 | A | | 11/1995 | Mochizuki et al. | |
| 5,897,445 | A | * | 4/1999 | Sanders | 473/421 |
| 5,979,426 | A | | 11/1999 | Troklus | |
| 6,026,798 | A | | 2/2000 | Sanders et al. | |
| 6,085,735 | A | | 7/2000 | Cheek, Jr. | |
| 6,093,117 | A | * | 7/2000 | Sherlock et al. | 473/422 |
| 6,152,126 | A | | 11/2000 | Smith et al. | |
| 6,237,583 | B1 | * | 5/2001 | Ripley et al. | 124/78 |
| 6,371,872 | B1 | | 4/2002 | Daley | |
| 6,443,141 | B2 | | 9/2002 | Battersby | |
| 6,470,873 | B2 | | 10/2002 | Battersby et al. | |
| 6,880,542 | B1 | * | 4/2005 | Johndreau et al. | 124/78 |
| 7,082,938 | B2 | | 8/2006 | Wilmot | |
| 2002/0104525 | A1 | | 8/2002 | Boehner | |
| 2002/0185120 | A1 | | 12/2002 | Scott | |
| 2003/0181265 | A1 | | 9/2003 | Raiss | |
| 2004/0261778 | A1 | * | 12/2004 | Wilmot | 124/78 |
| 2005/0092311 | A1 | | 5/2005 | Johndreau et al. | |
| 2005/0121016 | A1 | | 6/2005 | Johndreau et al. | |
| 2005/0161034 | A1 | | 7/2005 | Johndreau et al. | |

* cited by examiner

*Primary Examiner* — David L Lewis
*Assistant Examiner* — Eric M Thomas
(74) *Attorney, Agent, or Firm* — Chainey P. Singleton; Edwin S. Flores; Chalker Flores, LLP

(57) ABSTRACT

The present invention includes programs, devices and methods for a programmable ball throwing machine that is able to eject balls to preset, programmed or manually-selected positions with programmable projection and travel characteristics. The present invention includes a computer implemented method for controlling the parameters of a ball flight and trajectory in three dimensions including one or more parameters to identify a flight and trajectory of a ball in three dimensions for one or more player positions and a processor to control one or more motors in response to the one or more parameters.

21 Claims, 18 Drawing Sheets

SECTION A-A

PROGRAMMABLE BALL THROWING APPARATUS

CROSS-REFERENCE TO RELATED APPLICATIONS

This application is a continuation and claims priority based on U.S. patent application Ser. No. 10/973,395, filed Oct. 27, 2004, which claims priority to U.S. Provisional Patent Applications, Ser. No. 60/516,396; entitled "Programmable Ball Throwing Apparatus" filed Nov. 3, 2003.

TECHNICAL FIELD OF THE INVENTION

The present invention relates in general to the field of ball delivery devices and, more particularly, to programs, devices and methods for programming a ball delivering machine that is able to deliver balls to preset, programmed or manually selected positions with programmable travel characteristics.

BACKGROUND OF THE INVENTION

Without limiting the scope of the invention, its background is described in connection with devices, programs and methods relating to baseball, as an example.

Heretofore, in this field, a common training aid is the baseball pitching machine. Primarily, pitching machines are used for batting practice to simulate a human pitcher. Conventional pitching machines are used to pitch a variety of different pitches including fastballs, curveballs, sliders, knuckle-balls, and change-ups. However, these machines are designed to deliver a ball to a designated, two-dimensional strike zone, at a specific distance from the mound and with minor variations in speed, spin and the like. Therefore, the range of movement and design of a conventional pitching machine limits its functionality to the strike zone.

Baseball-launching equipment has concentrated on pitching characteristics in order to develop a player's batting skill. The following patents exemplify the current state-of-the art:

| | | |
|---|---|---|
| 4,760,835 | Paulson et al | Aug. 2, 1988 |
| 5,125,653 | Kovacs et al | Jun. 30, 1992 |
| 5,464,208 | Pierce | Nov. 7, 1995 |
| 5,979,426 | Troklus et al | Nov. 9, 1999 |
| 6,026,798 | Sanders et al | Feb. 22, 2000 |
| 6,152,126 | Smith et al | Nov. 28, 2000 |
| 6,443,141 B2 | Battersby | Sep. 3, 2002 |
| 6,470,873 B2 | Battersby et al | Oct. 29, 2002 |

Generally, these patents concentrate on pitching a ball for the express purpose of developing a player's batting skills at home plate. While one of the listed patents may be repurposed to launch balls to players in the field, it still maintains its two-dimensional targeting characteristics and does so without any programmable features or variable ball launch characteristics. Others were adapted to provide limited useful practice sessions for developing players fielding skills.

SUMMARY OF THE INVENTION

The present inventors recognized the need for an automated fungo practice aid that is able to deliver accurately an object into a three-dimensional space or landscape. The automated fungo does not rely on a person to deliver the ball to the desired position and therefore is not limited by human skill, conditioning and accuracies. The inventors realized what was need was a ball delivery device capable of moving vertically and horizontally to allow the delivery of one or more ball to any position on a field in three-dimensions. The present invention provides a fungoman machine that is capable of consecutively delivering balls to specified positions accurately and reproducibly. The invention allows a programmable sequence, which includes variation in both field position and flight characteristics.

For example, as part of many practices in baseball a person can be seen hitting grounders to the infield and fly balls to the outfielder and as such has become an important coaching tool. The term "fungo" is often used in infield and outfield practice as well as pre-game drills. Commonly, this person is referred to as the "fungoman." It is not uncommon for thousands of balls to be hit in a single day of baseball practice, which often requires special bats (e.g., fungo bats) and personnel to perform these tasks. Fungo bats are often lighter and longer, with a narrow barrel to help the hitter place the ball better. Additionally, the placement of the ball during practice is dependant on the skill and conditioning of the fungoman. Although the term fungo is commonly used in the context of baseball, the concept of fungo can apply to a variety of sports and activities.

Conventional pitching machines are designed to pitch balls to the strike zone of a batter at home plate. The conventional pitching machine is limited in the degree of movement in the vertical and horizontal planes as only small degrees of movement are required to adjust pitches to the strike zone. Furthermore, pitching machines are designed so that the vertical and horizontal movement is not readily detectable by the batter, so as not to indicate the type of pitch being thrown. However, prior to the development of present invention, there has never been a machine specifically designed to provide experienced coaches with field practice routines geared to the development of specific player fielding skills. Additionally, coaches with limited experience have not been able to purchase a machine with preprogrammed routines developed by a staff of experienced coaches.

The inventors realized the limited range of movement of conventional pitching machines made them unsuited for field practice or fungo practice. During fungo practice balls must be delivered to every position on field. To account for different field positions a machine would be required to rotate great degrees in the horizontal and vertical directions to allow coverage of the entire field of play.

The present invention relates to baseball and softball delivering machines and more particularly, to a programmable ball delivering machine that is able to direct balls (e.g., a baseball; a softball; a tee ball; a whiffle ball; a tennis ball; a cricket ball; a racquetball; a handball; a croquet ball, a shuffle board puck; a horse shoe; a volleyball; a dodge ball; a rugby ball; a football; a badminton birdie; field hockey puck; ice hockey puck; a lacrosse ball; a dog ball and a soccer ball) to preset, programmable or manually-selected fielding positions with programmable projection and travel characteristics. The present invention is designed to place balls in any or all fielding positions in a field (e.g., a baseball field, softball field, tee ball field, a whiffle ball field; a tennis court; a cricket field; a racquetball court; a handball court; a croquet field, a shuffle board; a horse shoe field; a volleyball court; a dodge ball court; a rugby field; a football field; a badminton court; field hockey field; ice hockey rink; a lacrosse field; a park and a soccer field). The present invention is designed to place balls with the one or more parameters identifying a flight and trajectory of a ball in three dimensions.

The present invention includes a computer program embodied on a computer readable medium for controlling the three dimensional flight and trajectory parameters of a ball including a first code segment for receiving one or more parameters identifying a flight and trajectory of a ball in three dimensions for one or more player positions and a second code segment for controlling one or more motors to eject the ball in accordance with the received one or more parameters identifying a flight and trajectory of a ball in three dimensions. The computer program may be implemented to control a three dimensional ball delivery apparatus. For example, the one or more parameters identifying a flight and trajectory of a ball provide realistic ball motion characteristics such as top spin, back spin, single-hop, multi-hop, line-drive, fly ball or pop-ups The computer program includes one or more parameters identifying a flight and trajectory of a ball in three dimensions related to one or more of the following: a base ball; a soft ball; a tee ball; a whiffle ball; a tennis ball; a cricket ball; a racquetball; a handball; a croquet ball, a shuffle board puck; a horse shoe; a volleyball; a dodge ball; a rugby ball; a football; a badminton birdie; field hockey puck; ice hockey puck; a lacrosse ball; a dog ball and a soccer ball.

The computer program also allows the user to define one or more of the following: the one or more parameters identifying a flight and trajectory correspond generally to the area on the field; one or more parameters identifying a flight and trajectory control a range of travel for the ball within the one or more player positions; one or more parameters identifying a flight and trajectory designate a groundball, a line drive, a fly ball or combinations thereof; one or more parameters identifying a flight and trajectory control a ball speed; and one or more parameters identifying a flight and trajectory control a ball spin. The area on the field may be the pitcher's mound, the home plate, the first base, the second base, the short stop, the third base, the left field, the right field, the centerfield or combinations thereof. Furthermore, the range of travel may include the extreme left side, the left side, the direct path, the right side, extreme right side or combinations thereof. The present invention also allows the ball spin to be selected form the group consisting of extreme backspin, backspin, normal spin, topspin, and extreme topspin. The positions, parameters and characteristics may be displayed on a display unit graphically, symbolically, as text or as combinations thereof to allow ease of use.

The computer program may further include one or more of the following: a code segment for controlling maintenance parameters such as upgrades and calibration; authenticating the user; identifying one or more levels of play and identifying the dimensions of the field. Additionally, the code segment may include parameters for specific routines, games, individual teams or specific persons.

The computer program of the present invention may include a first code sequence that receives a series of one or more of the one or more parameters that identify a flight and trajectory of a ball in three dimensions and correspond to one or more player positions, wherein the members of the series may correspond to the same player position or different player positions. The series of one or more parameters identifying a flight and trajectory of a ball may include one or more of the following: different field positions; for one or more individual positions; at least a portion of a game; an entire game; one or more specific players and one or more types of ball flight. Additionally, the level of play may be selected from the group consisting of pro, college, high school, junior and peewee. These general levels may be modified, thus, allowing the parameters to be tailored to specific applications and needs.

The present invention provides a method for controlling the parameters of ball flight and trajectory in three dimensional space including the steps of receiving one or more parameters identifying a flight and trajectory of a ball in three dimensions for one or more player positions and controlling one or more motors to eject the ball in accordance with the received flight and trajectory.

The one or more parameters identifying a flight and trajectory correspond generally to the area on the field, wherein the area is the pitcher's mound, the home plate, the first base, the second base, the short stop, the third base, the left field, the right field, the centerfield or combinations thereof. Additionally, the one or more parameters identifying a flight and trajectory may control a range of travel for the ball within the one or more player positions, wherein the range of travel includes the extreme left side, the left side, the direct path, the right side, extreme right side or combinations thereof. The combination of player position and range allows the coverage of entire field. The one or more parameters identifying a flight and trajectory may also be used to designate a groundball, a line drive, a fly ball or combinations thereof. The ball speed and ball spin (e.g., extreme backspin, backspin, normal spin, topspin and extreme topspin) may also be controlled, either separately or jointly, by the one or more parameters identifying a flight and trajectory, therefore, simulating a vast array of flight and trajectories allowing realistic ball movement. Additionally, the method may include the further step of receiving one or more parameters identifying one or more levels of play, wherein the level of play includes of pro, college, high school, junior, peewee or combinations thereof. The level may be set by the individual or preset as standard parameters.

The present invention also provides a method to simulate a series of plays, a partial game or an entire game. The series of plays may include past games, hypothetical games or games based on team statistics. The method may include receiving a series of two or more of the one or more parameters identifying a flight and trajectory of a ball for one or more player positions. The members of the series correspond to the same or different player positions, thus, allowing the development of specific routines and training programs. The series may include one or more parameters specific for one or more individual position; a partial game; an entire game; one or more parameters for a specific player; one or more parameters for a specific position, one or more parameters for different types of ball flights.

Additionally, the present invention provides a computer implemented method for controlling the parameters of a ball flight and trajectory in three dimensions including one or more parameters to identify a flight and trajectory of a ball in three dimensions for one or more player positions and a processor to control one or more motors in response to the one or more parameters. The one or more parameters identifying a flight and trajectory of a ball in three dimensions relates to one or more of the following: a base ball; a soft ball; a tee ball; a whiffle ball; a tennis ball; a cricket ball; a racquetball; a handball; a croquet ball, a shuffle board puck; a horse shoe; a volleyball; a dodge ball; a rugby ball; a football; a badminton birdie; field hockey puck; ice hockey puck; a lacrosse ball; a dog ball and a soccer ball. Furthermore, the one or more parameters to identify a flight and trajectory correspond generally to the area on the field, wherein the area is the pitcher's mound, the home plate, the first base, the second base, the short stop, the third base, the left field, the right field, the centerfield or combinations thereof.

The one or more parameters to identify a flight and trajectory may include one or more of the following: one or more parameters to control the range of travel for the ball within the one or more player positions, wherein the range of travel includes the extreme left side, the left side, the direct path, the right side, extreme right side or combinations thereof; one or more parameters to identify a flight and trajectory which designates a groundball, a line drive, a fly ball or combinations thereof; one or more parameters to identify a flight and trajectory and control the ball speed, wherein the ball speed is soft, medium, hard or combinations thereof; and one or more parameters to identify a flight and trajectory that control the ball spin, wherein the ball spin is selected from the group consisting of extreme backspin, backspin, normal spin, topspin, and extreme topspin.

Other components may be integrated into the apparatus to increase the ease of use and supply additional features. The present invention may further include one or more maintenance parameters, e.g., upgrades and calibrations. Additionally, a mechanism to authenticate the user; parameters to identify one or more levels of play (e.g., pro, college, high school, junior and peewee) and one or more parameters to identify the dimensions of the field may be included in the present invention. The apparatus may also include one or more of the following: a memory card and memory card reader, wherein the one or more parameters may be stored on the memory card (e.g., memory stick, disk, drive, card, tape, CD, DVD or minidisk) that may be inserted into a reader; an authentication card, a badge, a key, an input code, a keypad reader or touch screen, wherein one or more parameters may be entered on the keypad. One embodiment of the present invention may include a wired or wireless connection between the apparatus and a control unit to allow remote control of the apparatus. The controller may be linked to the apparatus through wired communications, wireless communications (e.g., bluetooth, wi-fi, frequencies in the 2.4 ghz range, frequencies in the 5.8 ghz range frequencies in the 900 mhz range, frequencies in the 40 mhz range or combinations thereof) or combinations thereof.

In one embodiment, the processor of the present invention may responds to a series of one or more of the one or more parameters to identify a flight and trajectory of a ball for one or more player positions. The members of the series may correspond to the same or different player positions. The series of one or more parameters to identify a flight and trajectory of a ball may correspond to different field positions; at least a portion of a game, an entire game, one or more teams, one or more specific players and one or more types of ball flight.

Another example of the present invention is a method for automated practice wherein the ball delivering apparatus controls the three dimensional parameters of a ball flight and trajectory including the steps of providing a ball delivering machine capable of controlling the flight and trajectory of a ball, supplying one or more parameters identifying a flight and trajectory of a ball for one or more player positions and controlling one or more motors to eject the ball in accordance with the received flight and trajectory. The method may include parameters for a series of balls that identifies a flight and trajectory of the ball for one or more player positions.

Another embodiment of the present invention is a fungoman having an automated baseball delivery control system and a baseball delivery unit, wherein the control system directs the three dimensional delivery of the baseball based on user defined parameters into a three dimensional space.

The present invention allows a programmed or manually selected sequence that is interactive with and controlled by a person to facilitate a varying ball delivery and catching session. This control may be with programs or parameters inputted, stored or transmitted to the apparatus. In some embodiments, the sequence may be specific for a team, an individual on a specific team, characteristics of a team, routines for a specific position or combinations thereof.

One embodiment of the present invention includes two or more counter-rotating wheels and independent wheel drive motors that facilitate rapid acceleration and deceleration from one speed and type of ball launch profile to another. Feedback may be provided through a variety of manners known to persons of ordinary skill in the art. Feedback in the machine provides closed-loop position control. A programmable logic controller, connected to a user-friendly operator/machine interface, allows the user to initiate pre-designated ball delivery practice sessions or develop new routines based on specific player needs. The controller may be linked to the apparatus through wired or wireless communications (e.g., bluetooth, wifi, frequencies in the 2.4 ghz range, frequencies in the 5.8 ghz range frequencies in the 900 mhz range, frequencies in the 40 mhz range or combinations thereof).

The present invention also provides for impromptu and spontaneous practice sessions using a manual mode that may be incorporated into the design to allow the code to launch a ball to an individual at a specific location with selected ball characteristics. The present invention also provides a semi-automatic mode, in which a routine may be set up for back hand field practice and then allow the coach to designate the positions to which the ball is to be thrown. In addition to the specified positions on the field, variations within those positions can be designated, e.g., high or low, left or right positions at each base and outfield position.

The present invention provides a program, apparatus and method, which allows a programmable launch sequences or routines for entire team training sessions, single position routines for specific position training, training sequences for specific teams, training sequences for specific players on a team, or combinations thereof. The present invention also provides for a variety of skill levels and ball speeds, e.g., pro, college, high school, junior and peewee.

Furthermore, the present invention provides precise, repeatable placement of the launched balls. The one or more parameters identifying a flight and trajectory correspond generally to an area on the field, wherein the area is the pitcher's mound, the home plate, the first base, the second base, the short stop, the third base, the left field, the right field, the centerfield or combinations thereof. The one or more parameters may also be used to identifying a flight and trajectory and control a range of travel for the ball within the one or more player positions, wherein the range of travel includes the extreme left side, the left side, the direct path, the right side, extreme right side or combinations thereof. The present invention may provide one or more parameters identifying a flight and trajectory to designate a groundball, a line drive, a fly ball or combinations thereof.

The present invention allows a variety of combinations of parameters identifying a flight, trajectory and skill levels to provide specific skill development. Furthermore, the user interface allow control through programming, manual input, stored parameters or combinations thereof. The present invention has the capacity to facilitate interruption of a training session and repeat a ball launch for timely coaching. The wireless communication allows personal instruction of the player at the field position.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

Figure 1:
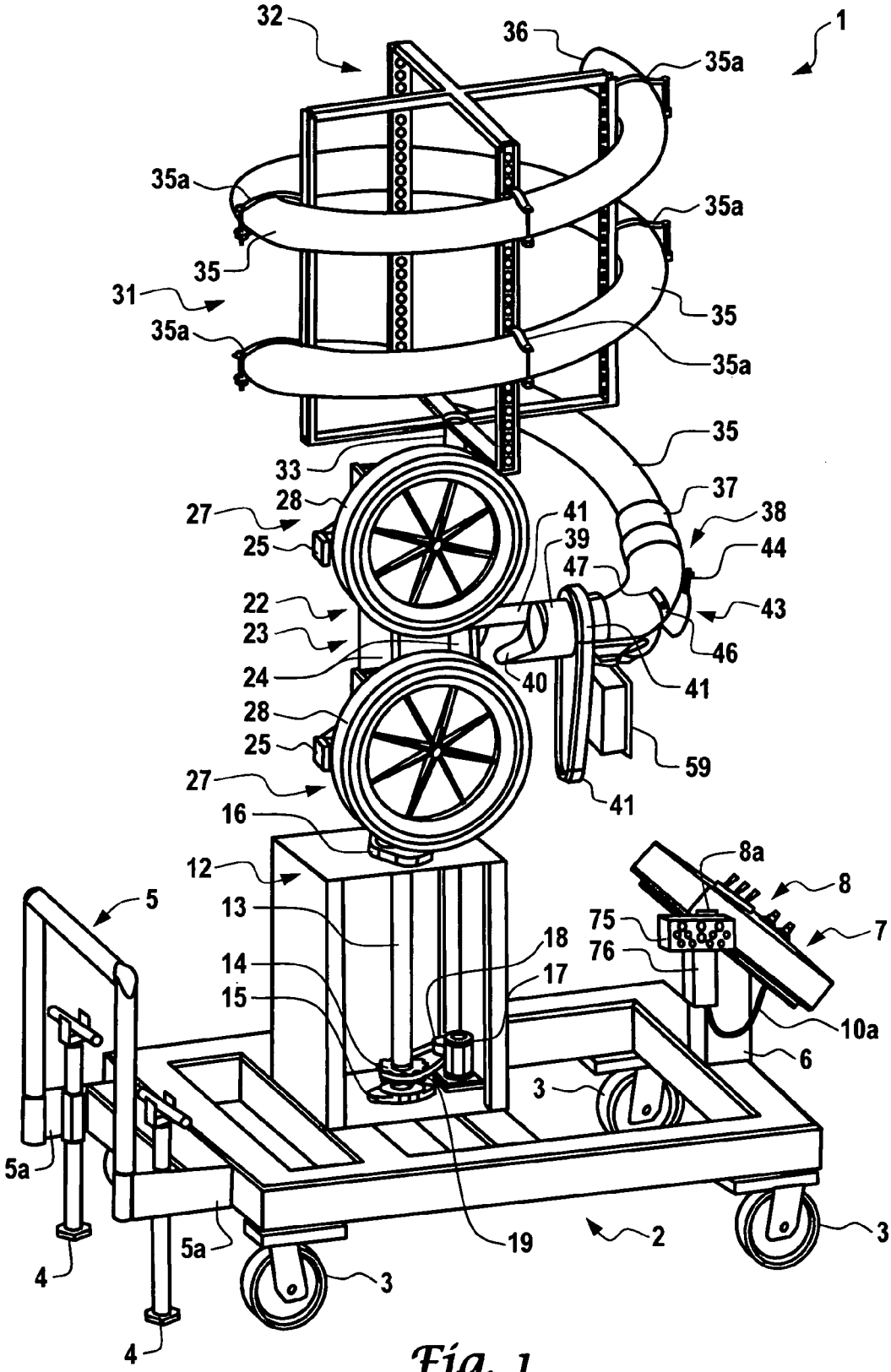
FIG. 1 is a side perspective view of one embodiment of the ball throwing apparatus of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

The word fungo is defined by Haney's Book of Reference as "[a]preliminary practice game in which one player takes the bat and, tossing the ball up, hits it as it falls, and if the ball is caught in the field on the fly, the player catching it takes the bat. It is useless as practice in batting, but good for taking fly balls . . . ." As used herein, the term "fungo" or "fungoman" are used to describe an apparatus and system that, unlike conventional baseball pitching machines that are only able deliver a ball to a two-dimensional target (i.e., the strike zone), is able to deliver any object to a three dimensional zone, area or landscape. The fungo may be fully-automated and/or used in manual mode.

Fungoman is best described as a programmable ball throwing machine that is able to eject hardballs or softballs to preset positions with programmable projection characteristics. In one embodiment, the machine is set-up at home plate on a baseball or softball field and through the use of the machine, a coach is able to train players by launching balls that simulate balls batted to them during regular play. A standard set of ball launching wheels have been mounted on a base with horizontal and vertical displacement capabilities that allow the ejection of a ball with the simulated characteristics of a baseball batted in the traditional manner of a batter using a baseball or softball bat. Closed loop positioning controls have been combined in a unique fashion that enables the launching of a series of balls to preprogrammed positions with launch characteristics that provides an entire baseball team or an individual with a meaningful practice session. Fungoman is a complete, automated coaching machine.

In order to train a baseball team, a coach must posses the ability to hit a ball that simulates a ball being hit by a batter during regular play. A special bat called a "fungo" bat has been developed for that specific purpose. However, use of a fungo bat requires a considerable amount of training and concentration on the part of the coach. This detracts from his ability to concentrate on coaching the player he is batting to. Once the problem of launching precisely placed balls with the desired launch characteristics have been overcome, a meaningful launch sequence must be developed into a realistic routine that leads to the enhancement of the ball player's skills. The coach needs to be free to analyze each player's reaction and fielding technique to each ball as it is hit to him. The coach also needs the ability to interrupt the launch sequence, give timely, specific instructions to a player and repeat the launch several times if necessary before resuming the practice session.

The apparatus and system of the present invention has the ability to precisely place objects, e.g., a baseball, with realistic characteristics such as top spin, back spin, single hop, multi-hop, line drive, fly ball or pop ups, in a programmed sequence interactive with and controlled by a coach to produce a meaningful ball catching practice session. To this end state-of-the-art motor drives with the ability to accelerate rapidly or decelerate from one speed and type launch profile to another have been used. Feedback provides closed loop position control and a programmable logic controller connected to a user-friendly man-machine interface that allows the user to call up pre-designated practice sessions or develop new routines based on specific player or team needs.

Fungoman can simulate previously played games enabling coaches to review errors or reinforce outstanding plays the team or individual performed in the simulated game. For impromptu practice sessions, a manual mode has been incorporated into the design to allow the coach to launch a ball to an individual at a specific location with specific launch characteristics. There is also a manual mode where the coach sets up the machine for back-hand field practice, for example, then selects which position the ball is to be thrown to and easily moves from position to position launching back-hand balls to each.

The following is an itemized list of some of the major distinguishing features of the machine:

1. Custom routines for individual or team training sessions.
2. Programmable launch sequences or routines for entire team training sessions.
3. Single position routines for specific position training.
4. Control of the ball speed appropriate to each player's skill level.
5. Precise, repeatable placement of the launched balls.
6. Ability to impart a realistic launch characteristic on the ball.
7. Position/Launch combinations for specific skill development.
8. Motor drives with acceleration and deceleration abilities.
9. Independent speed control of the launch wheels.
10. Safety-Enable switch with automatic shut-off when released.

11. User-friendly man/machine interface.
12. Ability to interrupt a training session and repeat a launch for timely coaching.
13. Use of programmable logic controller for dependable operation.
14. Unique positive stop, ball release mechanism.
15. Portability for ease of storage and relocation.

Referring initially to FIG. 1 in one embodiment the ball throwing apparatus of the present invention is generally illustrated by reference numeral 1 and includes a ball-ejecting mechanism 22, typically mounted on a utility box 12, which may be seated on a base or frame 2. The frame 2 may include wheels 3 to render the ball throwing apparatus 1 portable. Vertically-adjustable stabilizers 4 may also be provided on one end of the frame 2 and may be slidably seated in a handle frame 5*a* that mounts vertical elements of a handle 5 to engage the ground and facilitate stabilizing the ball throwing apparatus 1 in a particular location. A control mount pedestal 6 is typically provided on the end of the frame 2 opposite the handle 5, and serves to mount a control box 7 fitted with box controls 8 for operating the ball throwing apparatus 1, as hereinafter further described. A controller 75 is typically removably seated on a pin or bracket 8*a*, which extends from fixed attachment to the control box 7, as further illustrated in FIG. 1. In some embodiments, the controller 75 may be wireless, wired or even a touch screen display.

Figure 4:
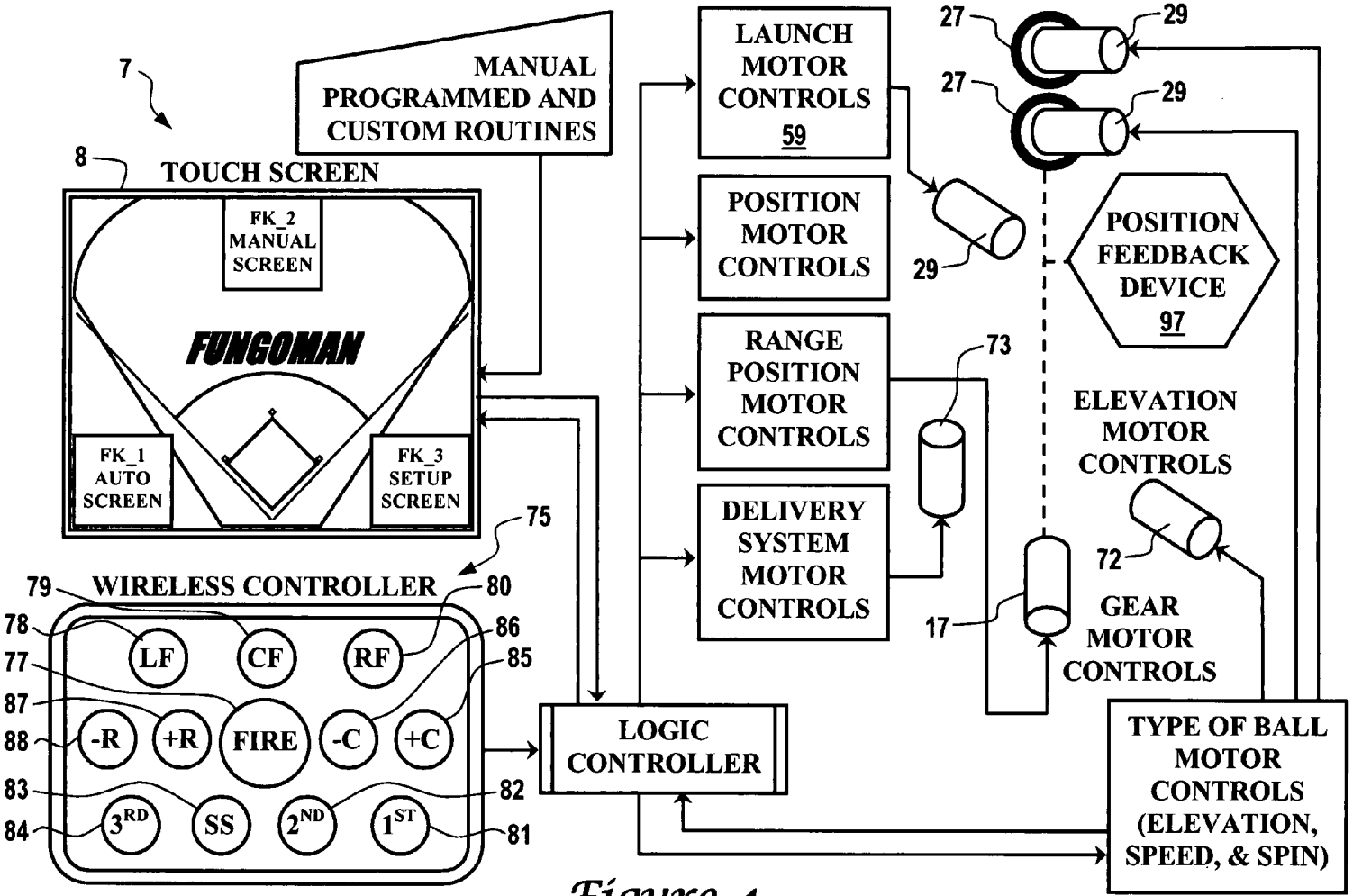
FIG. 4 is a schematic of an illustrative control system for various motors operated to actuate the ball ejection mechanism of the programmable ball throwing apparatus.

As illustrated in FIG. 4, the controller 75 may includes a handle 76, and hand control wiring 10*a* (FIG. 1) extends from the controller 75 to the control box 7 for manually operating the ball throwing apparatus 1 by manipulation of various buttons on the controller 75. In other embodiments the controller 75 may be wireless and linked to the apparatus 1 (e.g., bluetooth, wi-fi, frequencies in the 2.4 ghz range, frequencies in the 5.8 ghz range frequencies in the 900 mhz range, frequencies in the 40 mhz range or combinations thereof).

A mount pedestal 13 is journalled for rotation in a pedestal bottom bearing 15 attached to the bottom of the utility box 12, and a pedestal gear 14 is fixed to the mount pedestal 13 above the pedestal bottom bearing 15, as illustrated. A pedestal drive motor 17 is also fixed to the bottom of the utility box 12 and is fitted with a drive motor gear 18 that receives a pedestal drive belt 19. The pedestal drive belt 19 is also connected to the pedestal gear 14 in driving relationship such that operation of the pedestal drive motor 17 causes the mount pedestal 13 to rotate in the counterclockwise or clockwise direction in the pedestal bottom bearing 15 and in a corresponding top bearing 16 located in the top of the utility box 12. Operation of the pedestal drive motor 17 in rotating the mount pedestal 13 is facilitated by operation of the box controls 8 or the controller 75 at the control box 7, as further illustrated in FIG. 1 of the drawings.

Referring to FIG. 1 of the drawings, the mount pedestal 13 extends upwardly from the utility box 12, through the pedestal top bearing 16 and terminates at a horizontal offset plate 21 that mounts a ball feed frame support mount 34 which also extends upwardly to receive a ball feed frame support 33. The ball ejection mechanism 22 is mounted on the ball feed frame support mount 34. A mount clamp plate 62 of the ball ejection mechanism 22 is fixed to the top end of the ball feed frame support mount 34 and may include a rotatable clamp lever 63 that may be adjusted to pivot the ball ejection mechanism 22 in the vertical plane, as hereinafter further described. This adjustment is facilitated, for example, by means of a vertical pivot mount plate 61 mounted to a wheel mount frame 23 of the ball ejection mechanism 22, which vertical pivot mount plate 61 is pivotally attached to the mount clamp plate 62. In one embodiment, pivotal adjustment of the ball ejection mechanism 22 in a vertical plane is facilitated by means of an elevation motor 72 that is mounted on the ball feed frame support mount 34 or other element of the apparatus 1 and is operably connected to the wheel mount frame 23, according to the knowledge of those skilled in the art.

As further illustrated in FIG. 1 of the drawings, the wheel mount frame 23 is characterized by an elongated mount frame plate 24 extending from the vertical pivot mount plate 61 and fitted at each end with a wheel guard bracket 25 and corresponding wheel motor 29 for mounting the two counter-rotating wheels 27 on the wheel mount frame 23. Each of the counter-rotating wheels 27 is provided with a peripheral ball-contact surface 28 for contacting and expelling a baseball, softball or other ball from the ball ejection mechanism 22 due to the counter-rotating operation of the counter-rotating wheels 27 by operation of the respective wheel motors 29, as hereinafter further described. Horizontal positioning or aiming of the ball ejection mechanism 22 is facilitated by operation of the pedestal drive motor 17, which rotates the mount pedestal 13. The offset plate 21 translates the rotating motion of the mount pedestal 13 to the ball feed frame support mount 34, which moves the ball ejection mechanism 22 mounted thereon in the horizontal plane.

Referring again to FIG. 1 of the drawings, the ball feed frame 32, mounted on the extending upper end of the ball feed frame support 33, supports a spirally-mounted ball feed tube 35 by means of tube clamps 35*a*. The ball feed tube 35 includes a feed tube inlet 36 at the extending top end thereof and a feed tube outlet 37 at the bottom end thereof. A ball feed arm 38 is attached to the lower end of the ball feed tube 35 at the feed tube outlet 37 and includes feed arm slots 38*a*. A feed arm outlet 39 terminates the opposite end of the ball feed arm 38 and is aligned with the space between the counter-rotating wheels 27 to facilitate feeding of baseball, softball or other balls through the ball feeder tube 35 and the ball feed arm 38 and between the counter-rotating wheels 27 for ejection, respectively.

Referring to FIG. 1 of the drawings, a feed arm lip 40 is typically provided at the outlet or ejection end of the feed arm outlet 39 to support the balls 70 as they are sequentially fed from the feed arm outlet 39 to the space between the counter-rotating wheels 27 for ejection. As illustrated in FIG. 1, a feed arm bracket 41 is also provided on the feed arm outlet 39 to securely mount the feed arm outlet 39 to the wheel mount frame 23 of the ball ejection mechanism 22. A first ball feed trigger 43, from which extends a first ball contact finger 49, is pivotally secured to the ball feed arm 38 at a first trigger pivot pin 46. The first ball feed trigger 43 is connected to a first trigger pivot spring 44, which is pivotally secured to the ball feed arm 38 at a first trigger pivot spring mount 45. First trigger wiring 48 extends from a ball feed trigger control box 59, secured typically to the feed arm bracket 41, and is attached to the first ball feed trigger 43 to pivot the first ball feed trigger 43 between the ball-blocking position, with the first ball contact finger 49 projecting into the ball feed arm 38 through the feed arm slot 38*a*, and the ball-release position, where the first ball contact finger 49 clears the interior of the ball feed arm 38 against the bias exerted by the first trigger pivot spring 44.

Figure 2:
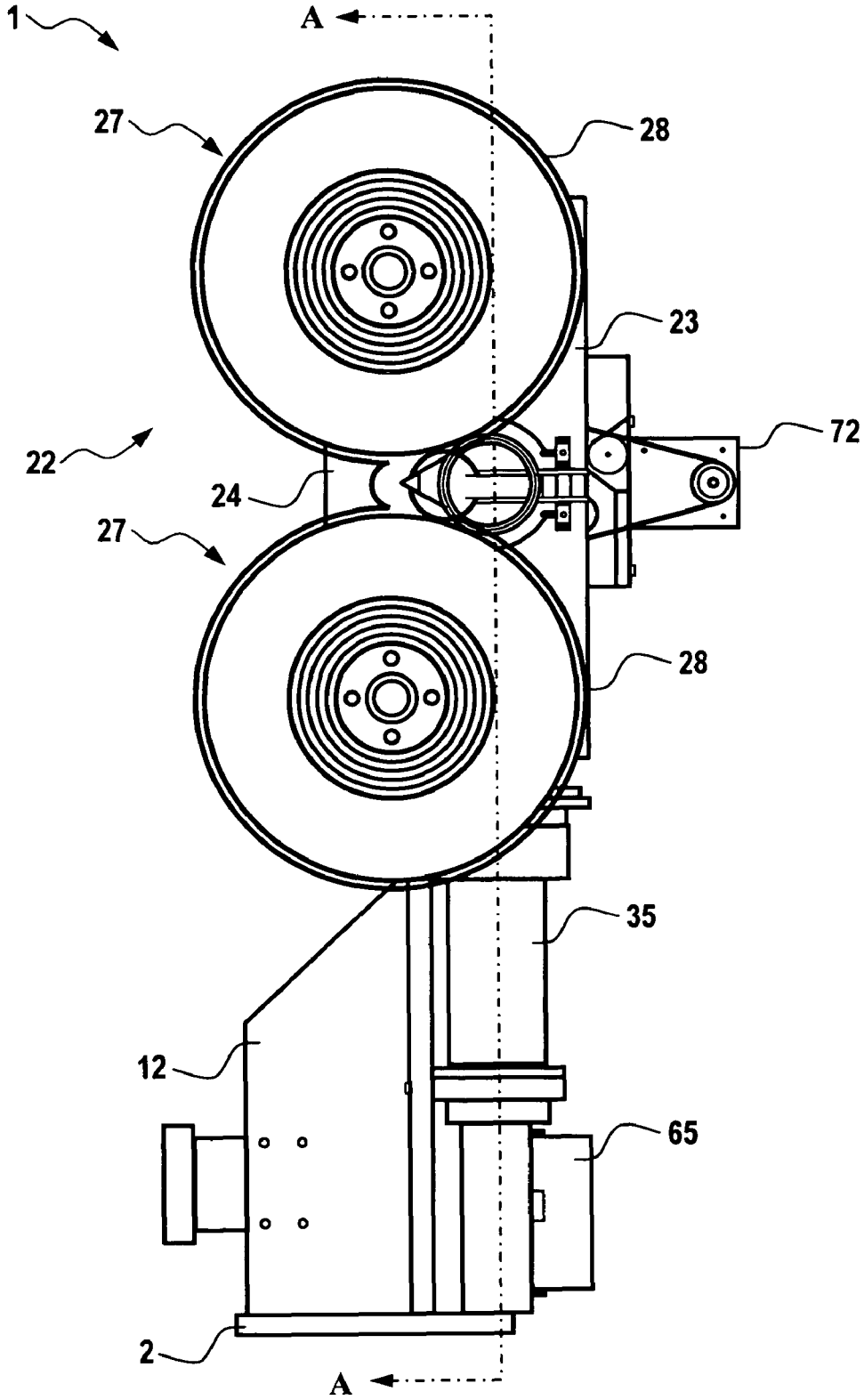
FIG. 2 is a side view of another embodiment of the ball throwing apparatus of the present invention.
Figure 3:
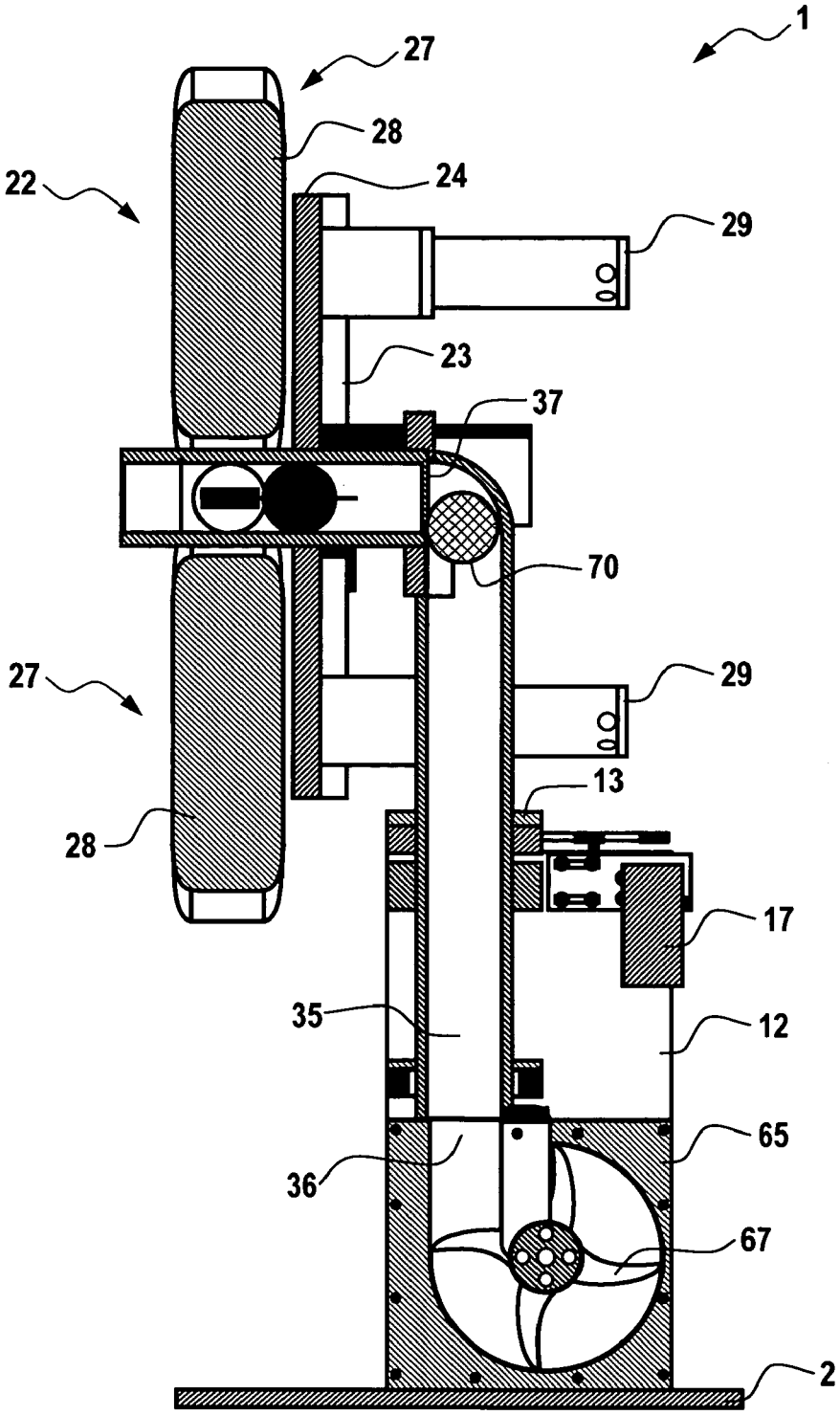
FIG. 3 is a front view of another embodiment of the ball throwing apparatus of the present invention.

Referring now to FIGS. 2 and 3, another embodiment the ball delivering apparatus of the present invention is generally illustrated by reference numeral 1 and includes a ball-ejecting mechanism 22, typically mounted on a utility box 12, which may be seated on a base or frame 2. The wireless control (not pictured) links to the to the wireless control box (not shown) for manually operating the ball throwing apparatus 1 by manipulation of various buttons on the wireless control box (not pictured), as further hereinafter described. The wireless link may be made through bluetooth, wi-fi, frequencies in the 2.4 ghz range, frequencies in the 5.8 ghz range frequencies in the 900 mhz range, frequencies in the 40 mhz range or combinations thereof.

A pedestal drive motor 17 is fixed to the utility box 12 and is also connected to the pedestal 13 such that operation of the pedestal drive motor 17 causes the mount pedestal 13 to rotate in the counterclockwise or clockwise direction in the pedestal. Operation of the pedestal drive motor 17 in rotating the mount pedestal 13 is facilitated by operation of the wireless control (not shown).

Referring again to FIGS. 2 and 3 of the drawings, the ball ejection mechanism 22 a wheel mount frame 23, which is mounted on the pedestal 13. A vertical pivot mount plate (not shown) mounted to a wheel mount frame 23 may be adjusted to pivot the ball ejection mechanism 22 in the vertical plane. In one embodiment, pivotal adjustment of the ball ejection mechanism 22 in a vertical plane is facilitated by the use of an elevation motor 72 that is mounted on the ball feed frame support mount 34 or other element of the apparatus 1 and is operably connected to the wheel mount frame 23, according to the knowledge of those skilled in the art.

As further illustrated in FIGS. 2 and 3 of the drawings, the wheel mount frame 23 is characterized by an elongated mount frame plate 24 and fitted at each end with a corresponding wheel motor 29 for mounting the two counter-rotating wheels 27 on the wheel mount frame 23. Each of the counter-rotating wheels 27 is provided with a peripheral ball-contact surface 28 for contacting and expelling a baseball, softball or other ball from the ball ejection mechanism 22 due to the counter-rotating operation of the counter-rotating wheels 27 by operation of the respective wheel motors 29. Horizontal positioning or aiming of the ball ejection mechanism 22 is facilitated by operation of the pedestal drive motor 17, which rotates the mount pedestal 13 in the horizontal plane. This may be accomplished using a wireless controller or a pendant controller.

Referring again to FIGS. 2 and 3 of the drawings, the ball hopper 65 is in connection with utility box 12 and feed tube 35. The ball hopper 65 is designed to accommodate storage of balls; however, the size and shape of the ball hopper 65 may be varied as needed for specific application, balls or the like. The ball feed tube 35 includes a feed tube inlet 36 at the utility box 12 and at the top end of the feed tube 35 is the feed tube outlet 37. A ball feed mechanism may be provided to sequentially feed balls 70 into the feed tube inlet 36 of the ball feed tube 35. A motor driven ball feed impeller 67 is attached to the lower end of the ball feed tube 35 at the feed tube outlet 36. The motor driven ball feed impeller 67 propels balls 70 into the ball feed tube 35 through the activation of delivery motor 73. In one embodiment, a sensor (not shown) is placed in feed tube 35, which is linked to the delivery motor 73 of the motor driven ball feed impeller 67 as to regulate its operation. Thus, allowing a continuous flow of balls 70 as long as balls 70 are in the ball hopper 65. A feed tube outlet 37 is aligned with the space between the counter-rotating wheels 27 to facilitate feeding of baseball, softball or other balls through the ball feeder tube 35 and between the counter-rotating wheels 27 for ejection, respectively.

Figure 5:
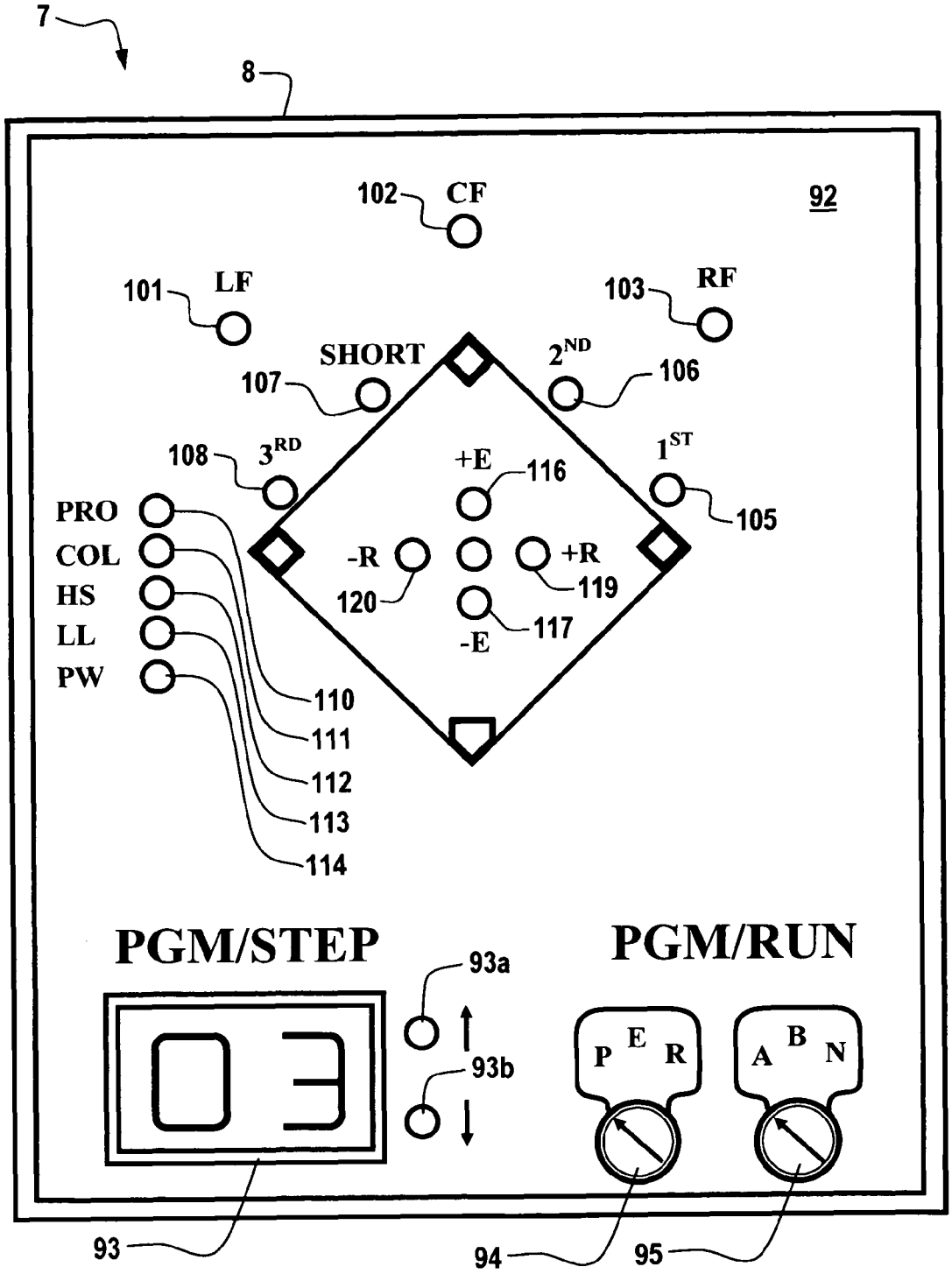
FIG. 5 illustrative of a screen display for the programmable ball throwing apparatus.
Figure 6A:
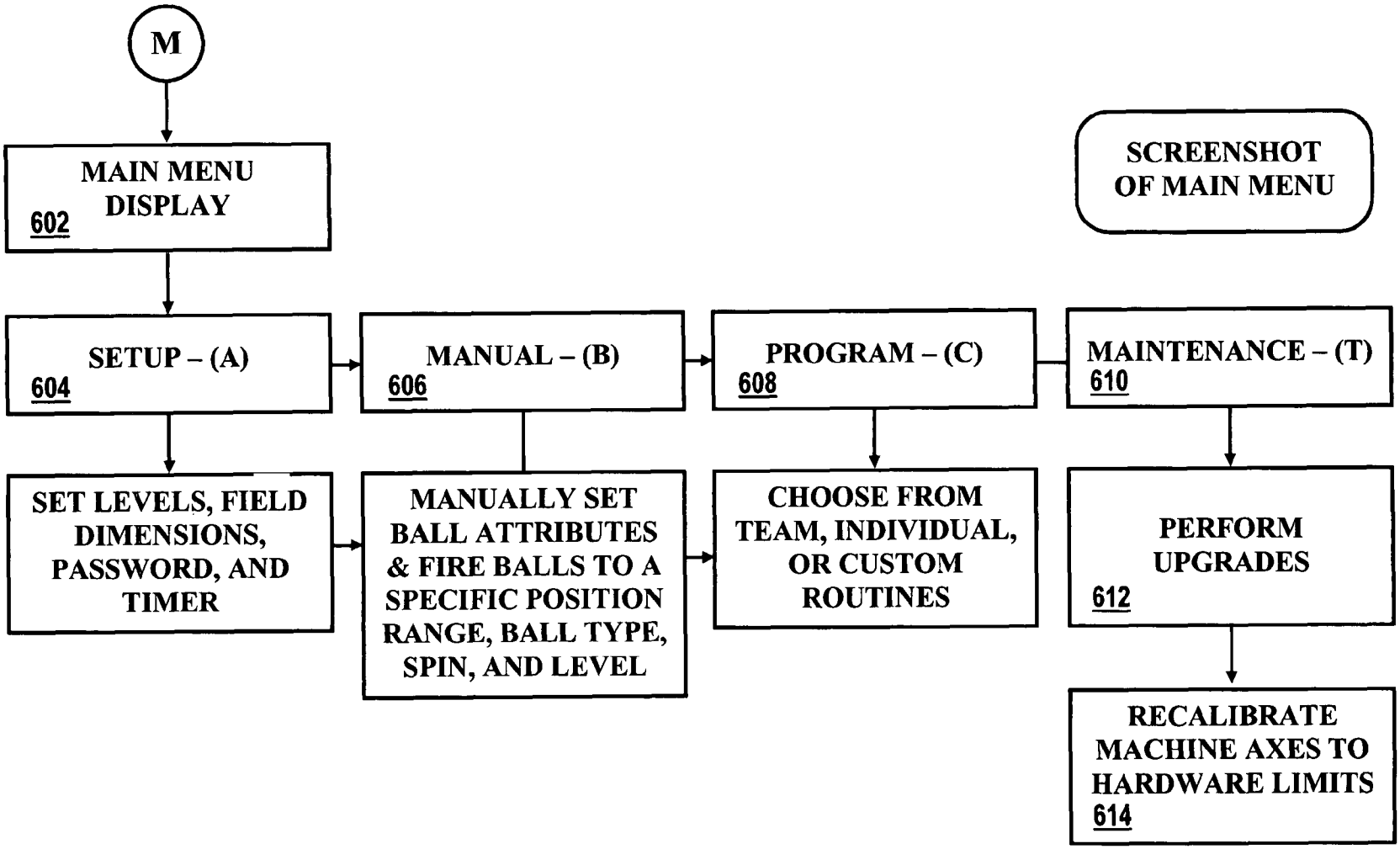
FIG. 6 is a flow diagram illustrating operation of the programmable ball throwing apparatus.
Figure 6B:
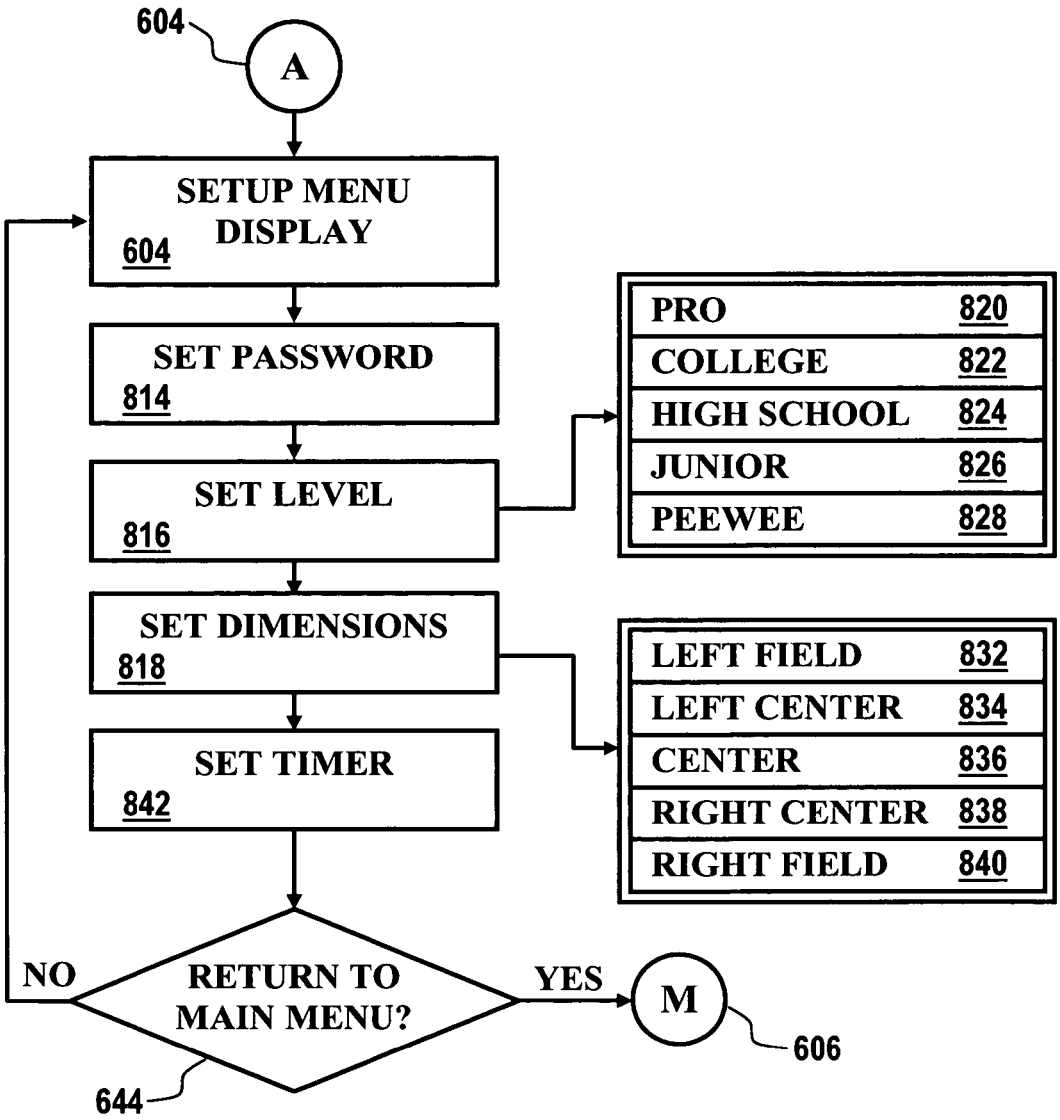
Figure 6C:
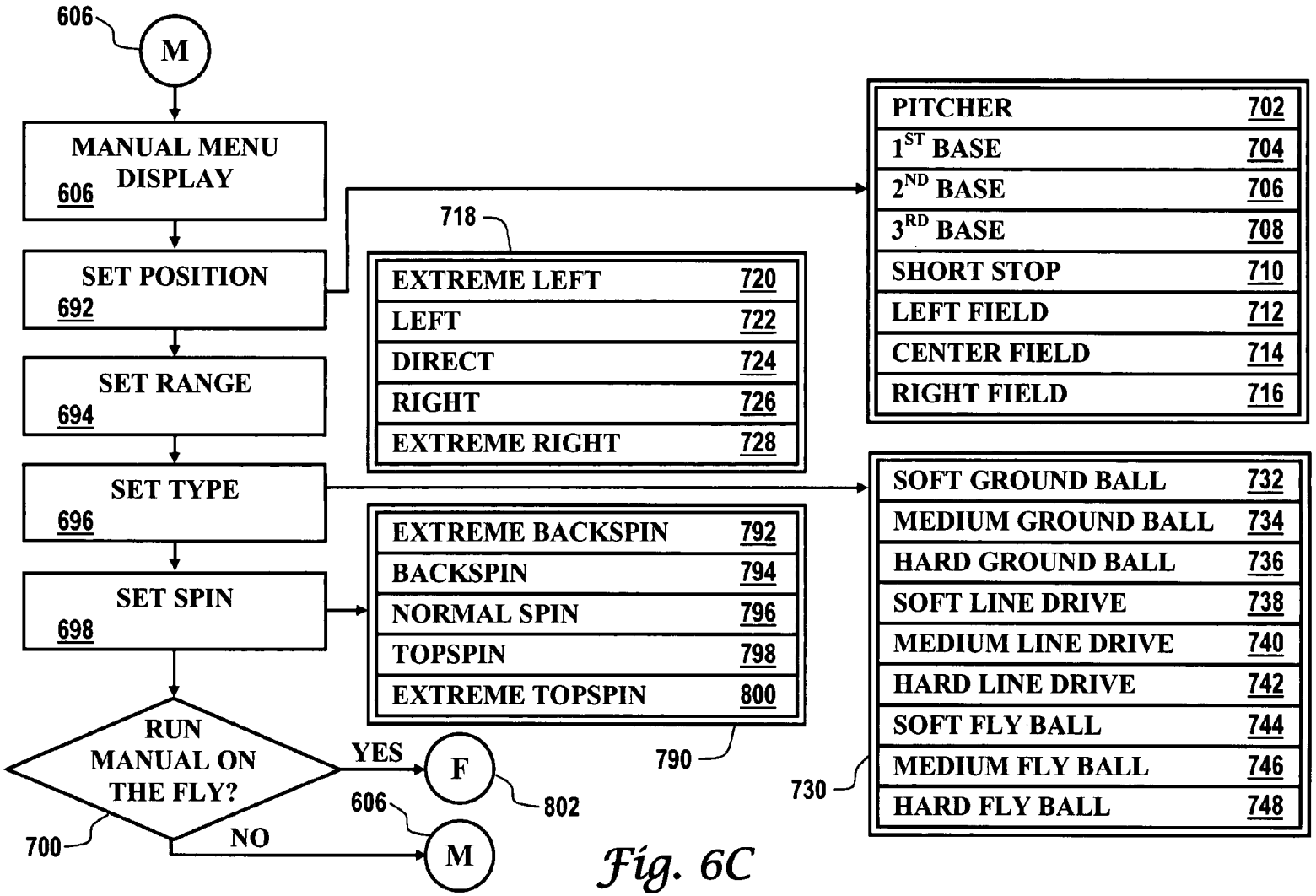
Figure 6D:
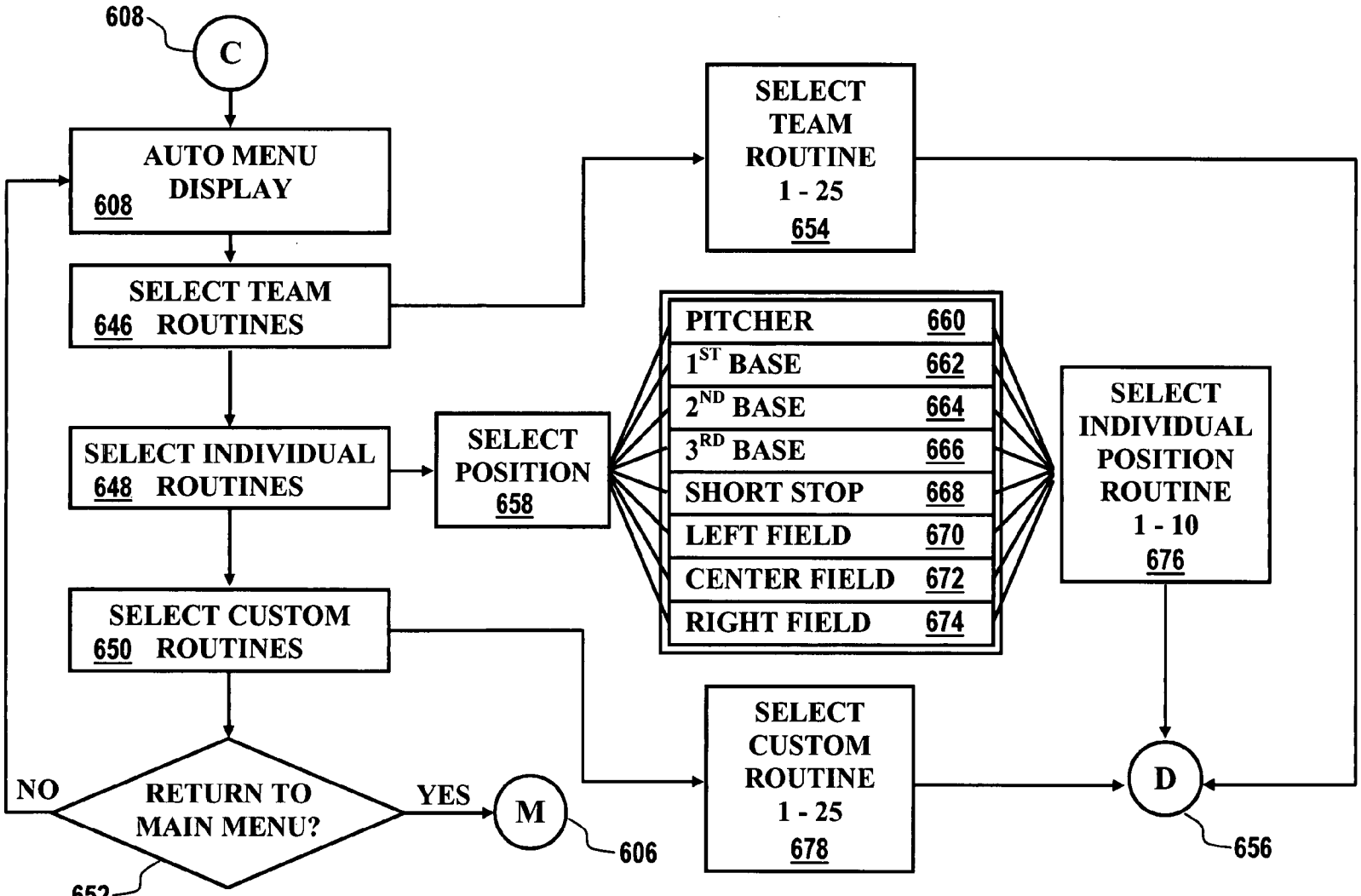
Figure 6E:
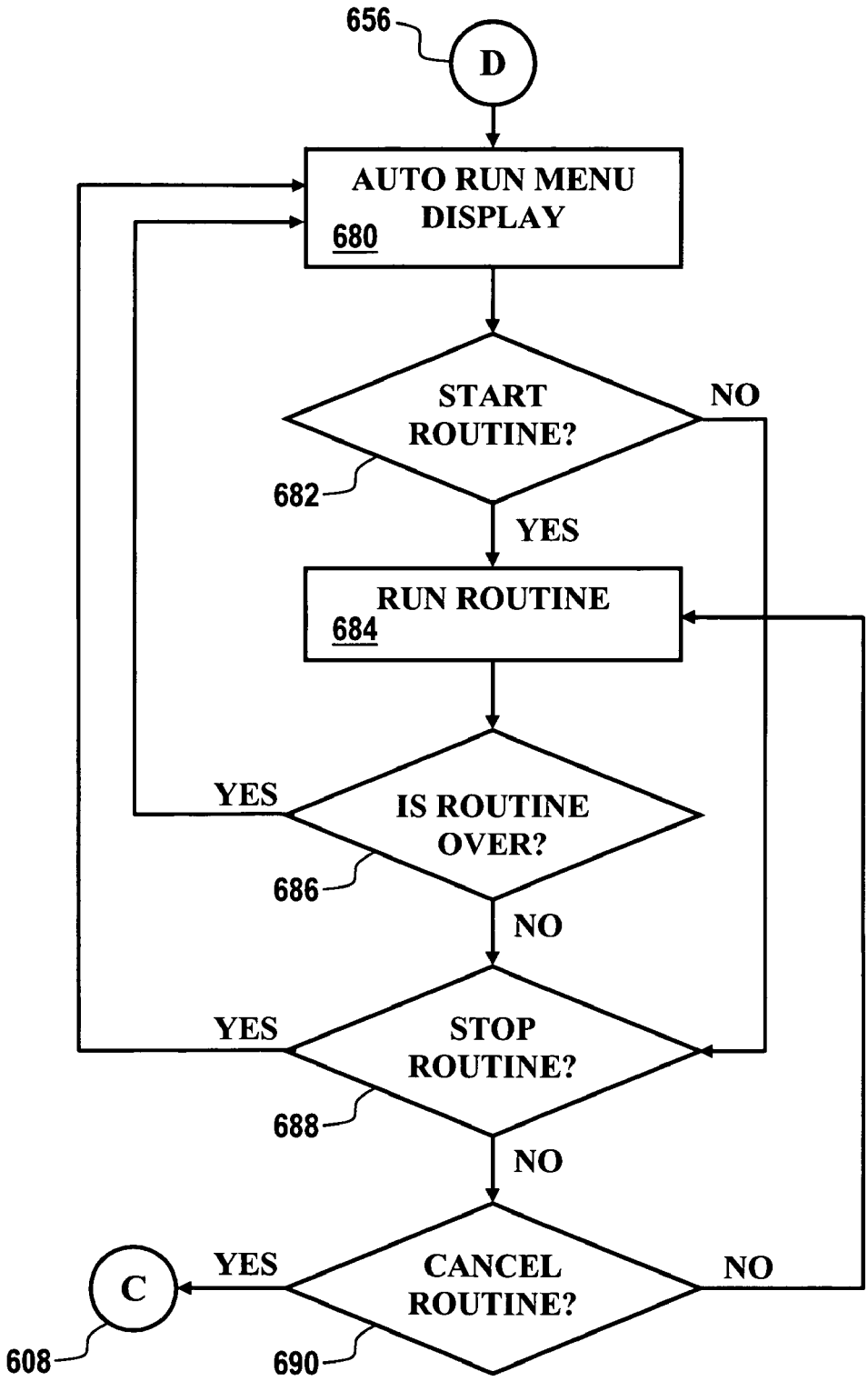
Figure 6F:
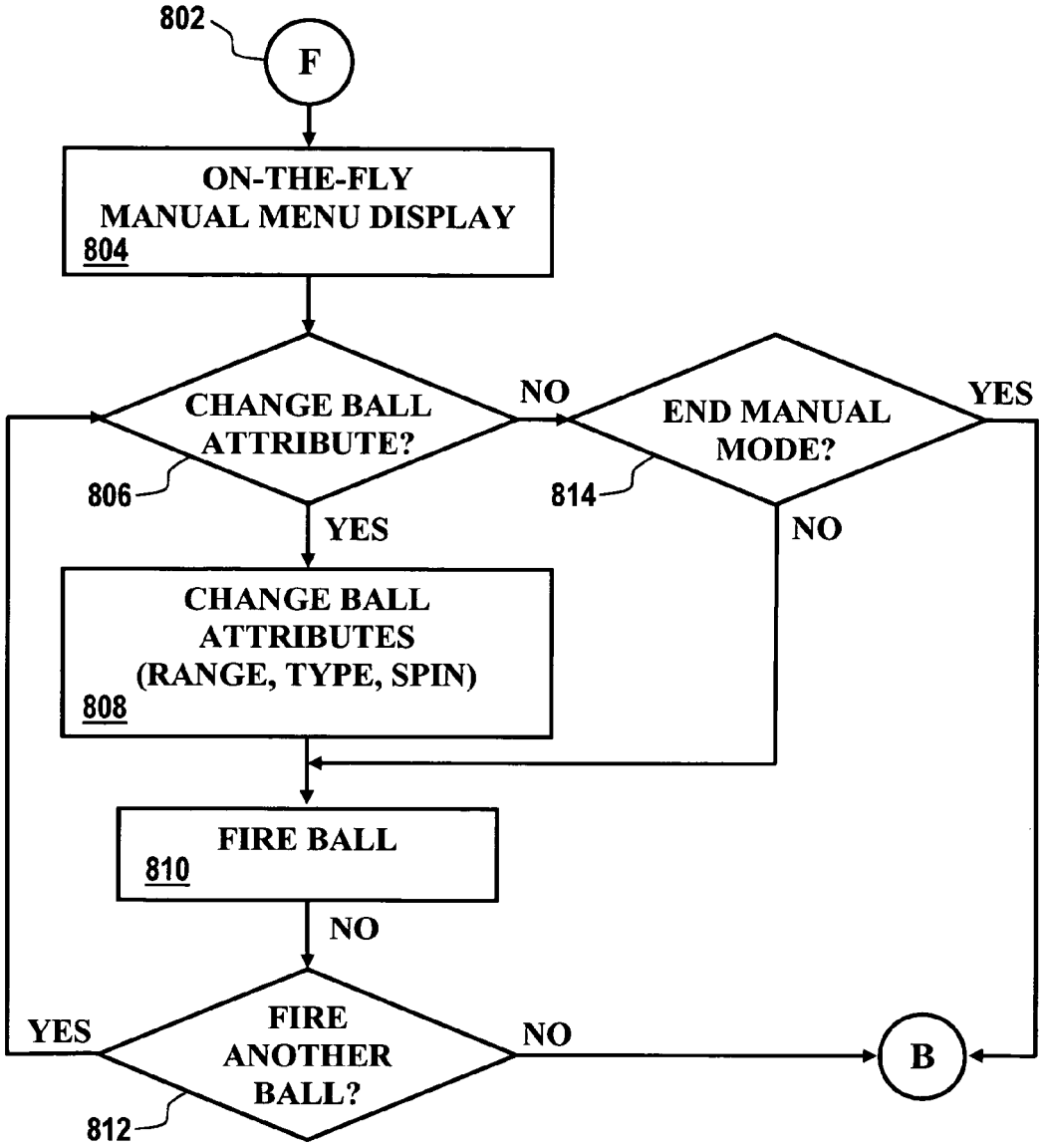

Referring next to FIGS. 4 and 5 the box controls 8 and the controller 75 are operably connected, through a programmable logic controller 90, to the pedestal drive motor 17, the respective wheel motors 29, the ball feed trigger control box 59, delivery system motor 73 and the elevation motor 72 to facilitate selected automatic or manual control of those components of the ball throwing apparatus 1, as hereinafter described. In another embodiment, box controls 8 and the controller 75 are operably connected wirelessly, through a programmable logic controller 90. Accordingly, the programmable ball throwing apparatus 1 can be operated according to an automatic mode, in which the ball ejection mechanism 22 launches each of a succession of balls 70 according to programmed ball launch characteristics, which include skill level, base or field position, range position and elevation. A positioning unit 97, operably connected to the logic controller 90, senses the base or field position, range position and elevation position of the ball ejection mechanism 22 with respect to a homing position, which is typically the line drive position at second base. Alternatively, the ball throwing apparatus 1 can be operated according to a manual mode, in which the ball ejection mechanism 22 launches each ball 70 according to manually selected skill level, base or field position, range position and elevation ball launch characteristics, using the pendant controller 75. In either the automatic mode or the manual mode, fielders (not illustrated) stand at the left field fielding position, center field fielding position, right field fielding position, first base fielding position, second base fielding position, short stop fielding position and/or third base fielding position in a baseball or softball outfield and attempt to catch the balls 70 launched from the ball ejection mechanism 22, to hone baseball or softball catching skills.

In the automatic mode, the ball ejection mechanism 22 is operated by the programmable logic controller 90, according to one of multiple programs each having multiple steps. At each step of a particular program, the ball ejection mechanism 22 launches a ball 70 according to the skill level, base or field position, range position, and elevation ball launch characteristics programmed for that step. In each step, the controller 75 is used to launch each ball 70 according to the programmed ball launch characteristics for that step. The ball launch characteristics of each step in a particular program are pre-selected and edited using the various control features of the box controls 8 of the control box 7, as hereinafter described. In the manual mode, the controller 75 is used both to select the ball launch characteristics for each step, typically with the exception of the skill level, and to launch each ball 70 from the ball ejection mechanism 22.

As illustrated in FIGS. 4 and 5, the box controls 8 of the control box 7 includes a control panel 92 having a left field position button 101, a center field position button 102 and a right field position button 103, each of which is typically a push-light button. The field position buttons 101-103 are used to program the logic controller 90 (FIG. 4) to position the ball ejection mechanism 22 at the left field fielding position, center field fielding position or right field fielding position, respectively, to launch each ball 70 toward that fielding position at a given step of a particular program. The control panel 92 further includes a first base position button 105, a second base position button 106, a shortstop position button 107 and a third base position button 108, each of which buttons 105-108 is typically a push-light button. The base position buttons 105-108 are used to program the logic controller 90 to position the ball ejection mechanism 22 at the first base fielding position, second base fielding position, shortstop fielding position or third base fielding position, respectively, to launch each ball 70 toward that selected base or shortstop fielding position at a given step of a particular program. Other embodiments may use a touch panel, a computer, a PDA, a hand held computer or a palm pilot.

In one embodiment of the programmable ball throwing apparatus 1, one of five different skill levels may be selected. These skill levels are "pee wee" (PW), corresponding to the slowest ball launch speed; "junior" (JR); "high school" (HS);

"college" (COL); and "pro" (PRO), corresponding to the highest ball launch speed. Accordingly, as further illustrated in FIGS. 4 and 5, the control panel 92 on the box controls 8 of the control box 7 includes a PRO skill level button 110, a COL skill level button 111, an HS skill level button 112, a JR skill level button 113, and a PW skill level button 114. The skill level buttons 110-114 are typically push-light buttons and are used to program the logic controller 90 to operate the launch motors 29 at various speeds, and therefore, launch each ball 70 between the wheels 27 at the speed, which corresponds to the selected skill level at a given step of a particular program.

An "up" elevation button 116 and a "down" elevation button 117, each of which is typically a push-light button, are provided on the control panel 92 and used to program the logic controller 90 to operate the elevation motor 72 to angle the ball ejection mechanism 22 along a vertical plane in a lowermost (−2) position, in which the ball ejection mechanism 22 launches a ball 70 in a "multi-hop" trajectory; a lower position (−1), in which the ball 70 is launched in a "one-hop" trajectory; a line drive (LD) position; an upper position (+1), in which the ball 70 is launched in a "fly ball" trajectory; and an uppermost (+2) position, in which the ball 70 is launched in a "pop fly" trajectory, at a given step of a particular program. Accordingly, the logic controller 90 is calibrated to initially position the ball ejection mechanism typically in the line drive (LD) position. The "up" elevation button 116 is pressed once to program the logic controller 90 to position the ball ejection mechanism 22 in the upper (+1) position and launch a "fly ball." The "up" elevation button 116 is pressed twice to position the ball ejection mechanism 22 in the uppermost (+2) position and launch a "pop fly." From the line drive (LD) position, the "down" elevation button 117 is pressed once to program the logic controller 90 to position the ball ejection mechanism 22 in the lower (−1) position and launch a "one-hop", and twice to program the logic controller 90 to position the ball ejection mechanism 22 in the lowermost (−2) position and launch a "multi-hop".

A right range button 119 and a left range button 120, each of which is typically a push-light button, are provided on the control panel 92 to program the logic controller 90 to operate the pedestal drive motor 17 to position the ball ejection mechanism 22 at a direct hit (0) position; at a forehand (−1) position, in which a ball 70 is launched to the left of each base or field fielding position; at a forehand (−2) position, in which a ball 70 is launched to the far left of each base or field fielding position; at a backhand (+1) position, in which a ball 70 is launched to the right of each base or field fielding position; and at a backhand (+2) position, in which a ball 70 is launched to the far right of each base or field fielding position, at a given step of a particular program. From the direct hit (0) position, the right range button 119 is pressed once to select the right backhand (+1) position and twice to select the far right backhand (+2) position. From the line drive position (LD), the left range button 119 is pressed once to select the left forehand (−1) position and twice to select the far left forehand (−2) position.

A program mode selector switch 94 and a run mode selector switch 95 are included on the control panel 92. The program mode selector switch 94 includes a "program" setting (P), an "edit" setting (E), and a "run" setting (R). The program mode selector switch 94 is set to the "program" setting (P) to select among the multiple ball-launch programs, each including multiple ball launch steps, whereas the program mode selector switch 94 is set to the "edit" setting to edit the various ball launch characteristics in a particular step of a given program, using the various control features on the control panel 92. The program mode selector switch 94 is set to the "run" (R) setting to run the selected and edited program in the automatic mode or to operate the apparatus 1 in the manual mode, which automatic or manual mode is selected using the run mode selector switch 95 as hereinafter described.

The run mode selector switch 95 includes an "automatic" setting (A), an "off" setting (O), and a "manual" setting (M). The switch 95 is set to the "automatic" setting (A) to run the apparatus 1 in the automatic mode, according to the ball launch program previously selected and edited using the program mode selector switch 94. The run mode selector switch 95 is set to the "manual" setting (M) to run the apparatus 1 in the manual mode, using the pendant controller 75. The program mode selector switch 95 is set to the "off" (O) position to turn off the apparatus 1.

The control panel 92 further includes a digital display 93 having an "up" selector button 93*a* and a "down" selector button 93*b*. When the program mode selector switch 94 is turned to the "P" setting to select the desired program to be edited or to be run in the automatic mode, the number of the program selected appears in the digital display 93. The "up" selector button 93*a* and the "down" selector button 93*b* are pressed to scroll through the available programs by number and select the program to be edited and/or run, as indicated by program number in the digital display 93. When the selected program appears by number in the digital display 93, the program mode selector switch 94 is next turned to the "E" setting to edit the desired step or steps in the selected program, using the various control features on the control panel 92. The number of the step being edited in the selected program appears in the digital display 93. The "up" selector button 93*a* and the "down" selector button 93*b* are pressed to scroll through the steps by number in the program and individually select each step to be edited, as indicated by number in the digital display 93.

Alternatively, in another embodiment the control box 7 may include box controls 8 in the form of a touch screen display. The touch screen display can display different regions of the box controls 8 as active and/or choices depending on the program in operation at the time. For example, the touch screen may display choices for a main menu which allows the selection of the mode of operation of the apparatus 1 by the selection of setup mode, manual mode, program mode, maintenance mode or manual on the fly mode as hereinafter described in FIG. 6 and in FIG. 7 as a screen shot of one embodiment of the touch screen controller.

When the apparatus 1 is run in the "manual" mode, as hereinafter further described, the controller 75 is used to manually control the various ball launch characteristics of the ball ejection mechanism 22. The controller 75 includes a first base position button 81 which is pressed to aim the ball ejection mechanism 22 toward the first base fielding position in a baseball or softball outfield, a second base position button 82 which is pressed to aim the ball ejection mechanism 22 toward the second base fielding position, a short-stop position button 83 which is pressed to aim the ball ejection mechanism 22 toward the short-stop fielding position, and a third base position button 84 which is pressed to aim the ball ejection mechanism 22 toward the third base fielding position. Accordingly, depression of the base position buttons 81-84 energizes the pedestal drive motor 17 to rotate the mount pedestal 13 in a clockwise or counterclockwise direction in order to facilitate proper positioning or aiming of the ball ejection mechanism 22 toward the selected base or shortstop fielding position.

A left field position button 78, a center field position button 79 and a right field position button 80 are provided on the controller 75. Depression of the left field position button 78, the center field position button 79 or the right field position button 80 energizes the pedestal drive motor 17 to rotate the mount pedestal 13 in order to facilitate proper positioning of the ball ejection mechanism 22 toward the selected left field fielding position, center field fielding position or right field fielding position, respectively, in the outfield.

An "up" elevation button 85 and a "down" elevation button 86 are typically included on the controller 75 to facilitate operation of the elevation motor 72 to pivot the ball ejection mechanism 22 in a vertical plane. Accordingly, the elevation motor 72 is calibrated to initially orient the ball ejection mechanism 22 typically in a line drive (LD) homing position, in which balls 70 are ejected from the ball ejection mechanism 22 in a generally horizontal, line-drive trajectory. By one depression of the "up" elevation button 85, the elevation motor 72 tilts the ball ejection mechanism 22 upwardly to an upper "fly ball" (+1) elevation position, such that the ball ejection mechanism 22 ejects balls 70 in a fly ball trajectory. By two depressions of the "up" elevation button 85, the elevation motor 72 tilts the ball ejection mechanism 22 upwardly to an uppermost "pop fly" (+2) elevation position, such that the ball ejection mechanism 22 ejects balls 70 in a pop fly trajectory. With the ball ejection mechanism 22 oriented in the line drive homing position, the "down" elevation button 86 is pressed once to cause the elevation motor 72 to tilt the ball ejection mechanism 22 downwardly, such that balls 70 are ejected in a "one hop" (−1) trajectory. By depression of the "down" elevation button 86 twice, the elevation motor 72 tilts the ball ejection mechanism 22 downwardly such that balls 70 are ejected in a "multi hop" (−2) trajectory.

The controller 75 further includes a right range button 87 and a left range button 88 which can be pressed to actuate the pedestal drive motor 17 to position the ball ejection mechanism 22 toward a far right (+2) backhand position, a right (+1) backhand position, a center or direct hit (0) position, a left (−1) forehand position or a far left (−2) forehand position, respectively, of each first base, second base, short stop or third base fielding position, selected using one of the position buttons, or to the left, far left, right or far right of each left field fielding position, center field fielding position or right field fielding position selected using the left field position button 78, center field position button 79 or right field position button 80. For example, the programmable ball throwing apparatus 1 is typically calibrated to aim the ball ejection mechanism 22 toward the center or line-drive (LD) position of the selected base or field fielding position. Depression of the left range button 88 once facilitates positioning of the ball ejection mechanism 22 toward the left forehand (−1) position, whereas depression of the right range button 87 once facilitates aiming of the ball ejection mechanism 22 toward the right backhand (+1) position. Depression of the left range button 88 twice facilitates positioning of the ball ejection mechanism 22 toward the far left forehand (−2) position, whereas depression of the right range button 87 twice facilitates positioning of the ball ejection mechanism 22 toward the far right backhand (+2) position. Like the base position buttons 81-84 and the field position buttons 78-80, the right range button 87 and left range button 88 energize the pedestal drive motor 17 to rotate the mount pedestal 13 in a clockwise or counterclockwise direction in order to facilitate proper positioning of the ball ejection mechanism 22 to the right or left of the selected base or field position.

A right position indicator light (not illustrated) and a left position indicator light (not illustrated) may be further provided on the controller 75. Accordingly, when the ball ejection mechanism 22 is aimed toward the right backhand (+1) position of one of the base or field positions, the right position indicator light is continuously illuminated. When the ball ejection mechanism 22 is aimed toward the far right backhand (+2) position of one of the base or field positions, the right position indicator light flashes or blinks. Conversely, when the ball ejection mechanism 22 is aimed toward the left forehand (−1) position of a base or field position, the left position indicator light is continuously illuminated. The left position indicator light flashes or blinks when the ball ejection mechanism 22 is aimed toward the far left forehand (−2) position. When the ball ejection mechanism 22 is aimed in the center range or line drive (LD) position of one of the base or field positions, neither the right position indicator light nor the left position indicator light is illuminated or flashes.

A launch button 77 provided on the controller 75 is pressed to manually launch each ball 70 from the ball ejection mechanism 22, toward the desired base or field position, range position and elevation position in the baseball or softball outfield previously selected by pressing one of the base position buttons 81-84, range position buttons 87, 88, and elevation position buttons 85, 86. Accordingly, the launch button 77 actuates the release one of the balls 70 between the rotating wheels 27.

Figure 7:
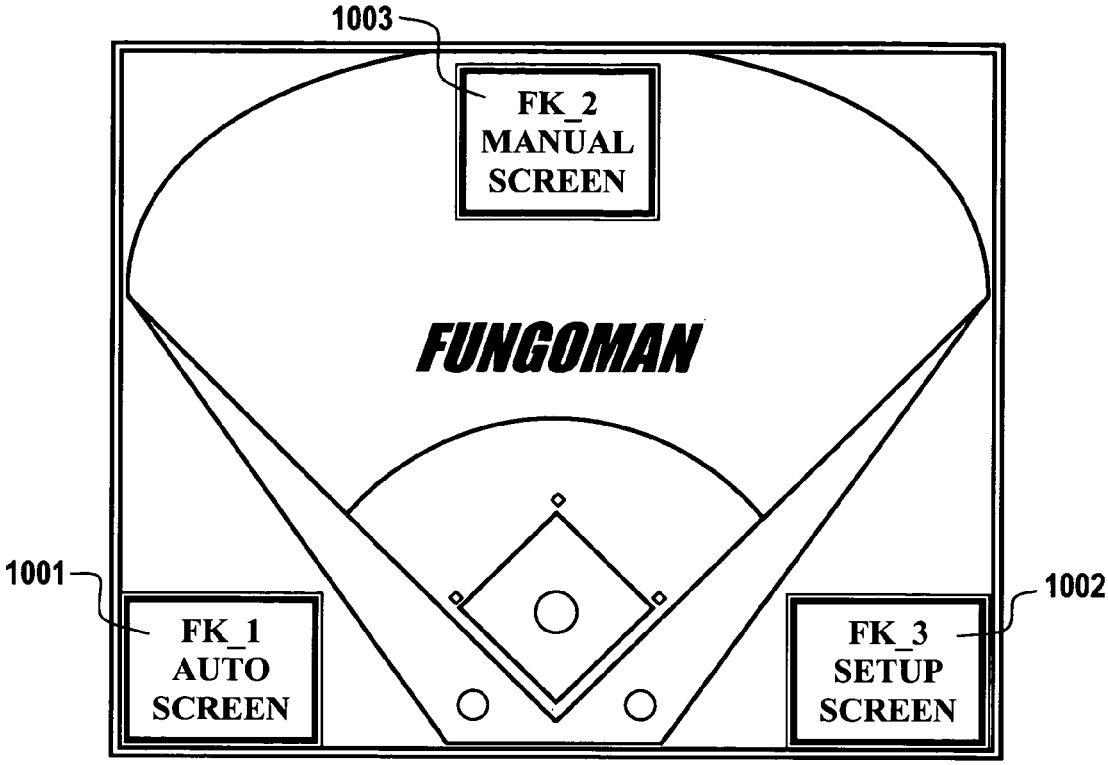
FIG. 7-12 are screen shots illustrating a typical sequence of operational steps.

Referring next to FIG. 6, the programmable ball throwing apparatus 1 is capable of being operated in an automatic mode or a manual mode, as hereinafter described. As illustrated in FIG. 6, block 602 displays a main menu which allows the selection of the mode of operation of the apparatus 1 by the selection of block 604 setup mode, block 606 manual mode, block 608 program mode, block 610 maintenance mode or block 700 manual on the fly mode as hereinafter described. For example, FIG. 7 is a screen shot of one embodiment of block 602 displayed on a touch screen controller. The activation of area 1001, 1002 and 1003 on the controller results in the activation of block 608, 604, and 606 respectively.

The selection of block 610 maintenance mode from the main menu 602 provides the choice of block 612, which allows upgrades to the apparatus 1 and selection of block 614 for recalibration of the apparatus 1.

The selection of block 608 initiates the program mode, which allows the selection of block 646 team routines, block 648 individual routines, block 650 custom routines or block 652 return to the main menu. The selection of block 646 team routines allows the selection of block 654, which includes a variety of routines, which include variations in the sequential delivery of balls having the desired parameters to different positions. Block 654 then proceeds to block 656.

The selection of block 648 individual routines allows individual routines to be selected by initiating block 658, which allow the selection of position by the selection of the blocks 660 to 674, which correspond to field positions. Block 660 corresponds to the pitcher, block 662 corresponds to the first base, block 664 corresponds to the second base, block 666 corresponds to the short stop position, block 668 corresponds to the third base position, block 670 corresponds to the left field position, block 672 corresponds to the center field position and block 674 corresponds to the right field position. Once block 660 to 674 has been selected and the position designates the block 676, the selection of individual routines may be activated. Block 678 includes variations to one or more parameters identifying the ball flight and trajectory. In the automatic mode, the ball ejection mechanism 22 is operated by the programmable logic controller 90, according to one of multiple programs each having multiple steps. At each step of a particular program, the ball ejection mechanism 22 launches a ball 70 according to the skill level, base or field position, range position, and elevation ball launch characteristics programmed for that step. In each step, the controller 75 is used to launch each ball 70 according to the programmed ball launch characteristics for that step. The selection of block 650 custom routines initiates block 678. Block 678 allows the selection of customized routine, which vary the sequential delivery of balls and have different parameters identifying a flight and trajectory having the parameters desired by the user. Once the routine is selected block 678 is selected block 656 is initiated.

Figure 8:
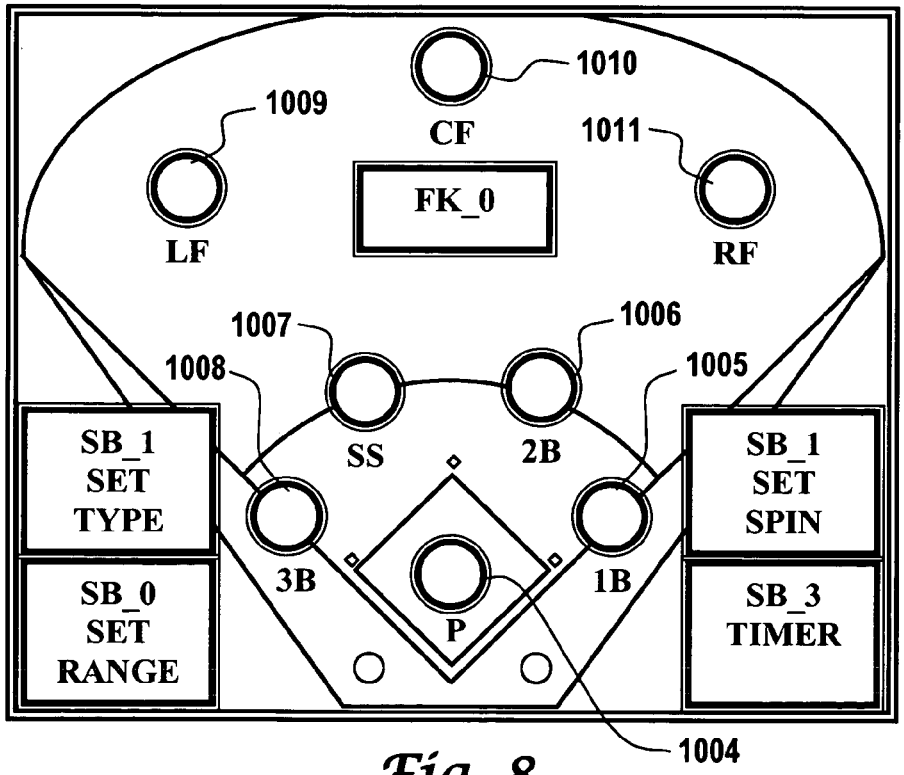

For example, FIG. 8 is a screen shot of one embodiment of block 658 on a touch screen controller. The activation of area 1004, 1005, 1006, 1007, 1008, 1009, 1010 and 1011 on the controller results in the activation of block 660 which corresponds to the pitcher, block 662 which corresponds to the first base, block 664 which corresponds to the second base, block 666 which corresponds to the short stop position, block 668 which corresponds to the third base position, block 670 which corresponds to the left field position, block 672 which corresponds to the center field position and block 674 which corresponds to the right field position respectively.

Block 656 initiates block 680 the run menu display, which in turn initiates block 682, which prompts the user to start the routine. If the user elects to start the routine block 684 is initiated and runs the routine, thus, operating the apparatus. Block 686 is then activated, which prompts the user to determine if the routine is over. A positive response to block 686, causes block 680 to be reinitiated. A negative response to block 686 initiates block 688, which prompts the user to stop the routine. If the routine is stopped then block 680 to be reinitiated. If the routine is not stopped then block 690 is initiated, which prompts the user to cancel the routine. A positive response to block 690 to cancel the routine will reinitiate block 608 and a negative response will reactivate block 684 causing the operation of the apparatus 1. Alternatively, at block 682 if the user elected not to run the routine then block 688 will be initialized.

Figure 9:
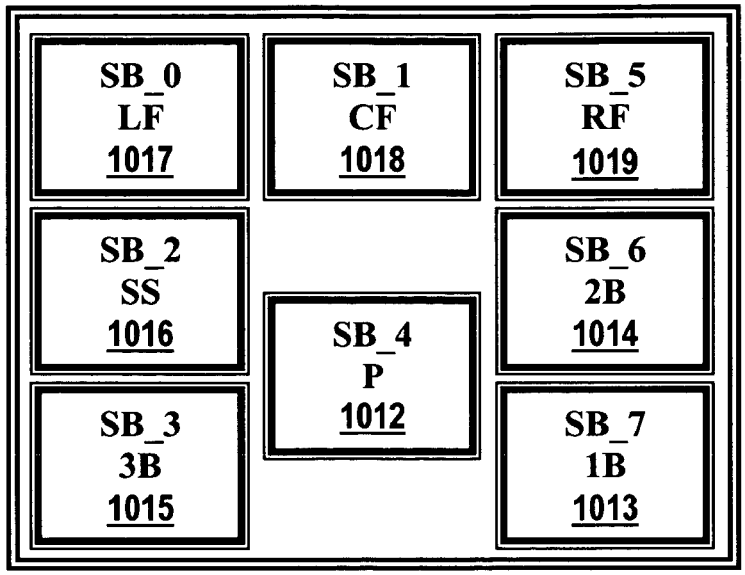

Alternatively, at block 602, block 606 manual mode may be selected. Block 606 manual mode allows the selection of block 692 to set the position, block 694 to set the range, block 696 to set the type, block 698 to set the spin and block 700 the fly mode. The selection of block 692 allows the position to be selected by selecting blocks 702 to 716, which correspond to field positions. Block 702 corresponds to the pitcher, block 710 corresponds to the first base, block 706 corresponds to the second base, block 708 corresponds to the short stop position, block 708 corresponds to the third base position, block 712 corresponds to the left field position, block 714 corresponds to the center field position and block 716 corresponds to the right field position. For example, FIG. 9 is a screen shot of one embodiment of block 730 on a touch screen controller. The activation of area 1012, 1013, 1014, 1015, 1016, 1017, 1018 and 1019 on the controller results in the activation of block 702, 704, 706, 708, 710, 712, 714 and 716 respectively.

Figure 10:
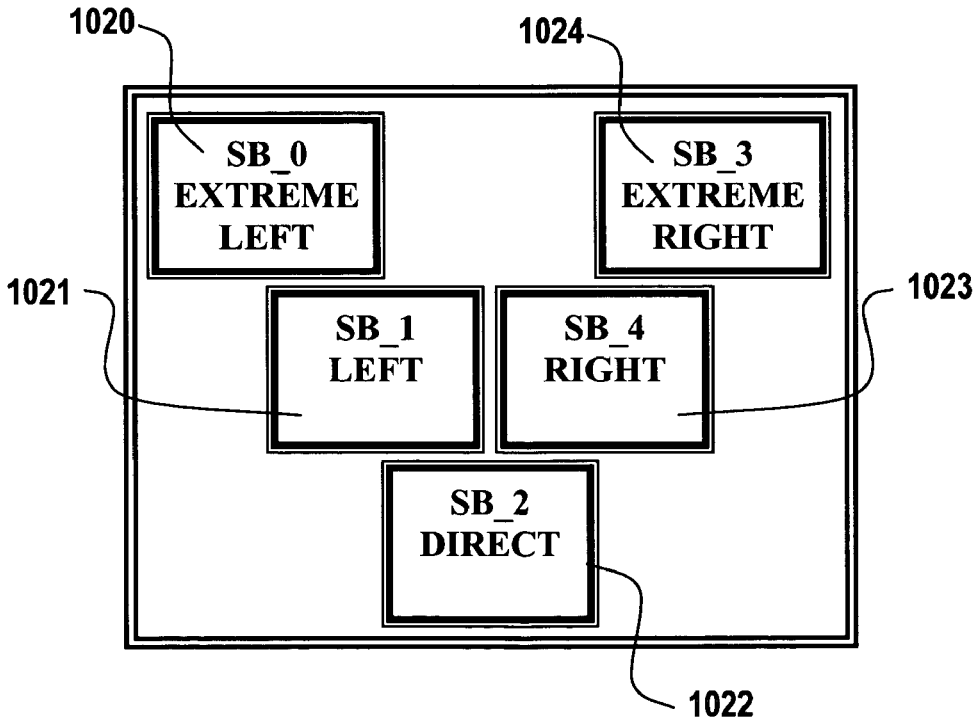

If block 694 was selected then block 718 is initiated, which allows the selection of the range. Block 718 defines the range through the selection of blocks 720-728. Block 728 extreme right, block 726 right, block 724 direct, block 722 left, block 720 extreme left. For example, FIG. 10 is a screen shot of one embodiment of block 718 on a touch screen controller. The activation of area 1020, 1021, 1022, 1023 and 1024 on the controller results in the activation of block 720, 722, 724, 726 and 728 respectively.

Figure 11:
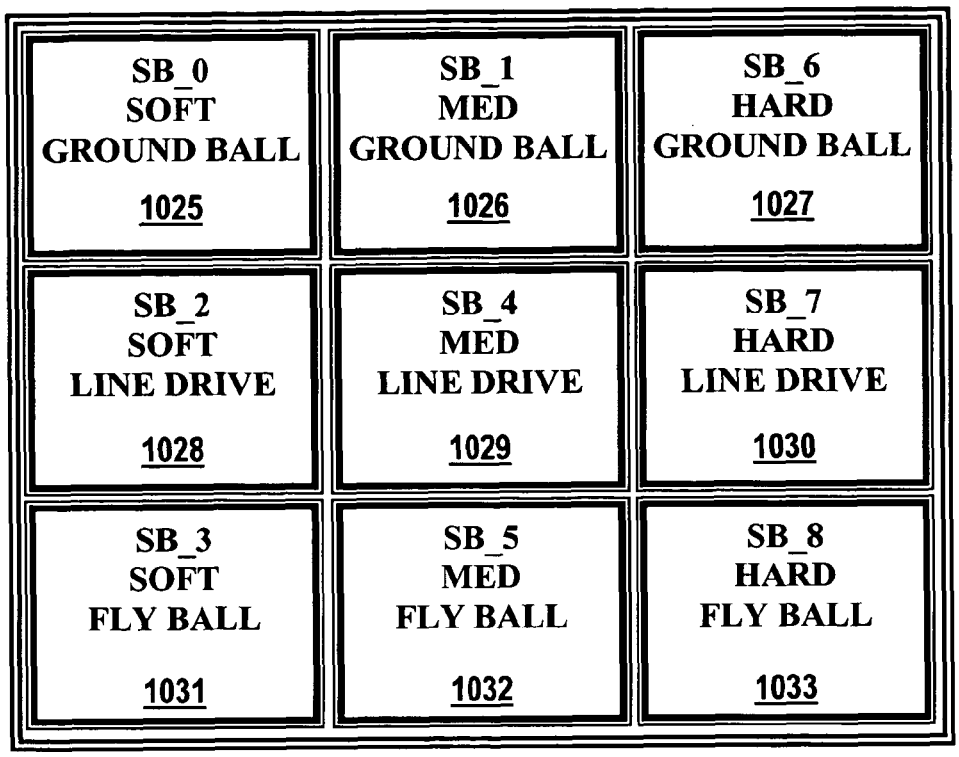

If block 696 was selected then block 730 is initiated, which allows the selection of the characteristics of ball to be delivered block 732 to 747. The characteristic (e.g., groundball, line drive or fly ball) of the ball may be selected: block 732 soft groundball, block 734 medium groundball, block 736 hard groundball, block 738 soft line drive, block 740 medium line drive, block 742 hard line drive, block 744 soft fly ball, block 746 medium fly ball or block 747 hard fly ball. For example, FIG. 11 is a screen shot of one embodiment of block 718 on a touch screen controller. The activation of area 1025, 1026, 1027, 1028, 1029, 1030, 1031, 1032 and 1033 on the controller results in the activation of block 732, 734, 736, 738, 740, 742, 744, 746 and 748 respectively.

If block 698 was selected then block 790 is initiated, which allows the selection of the spin of the ball through the selection of block 792 extreme back spin, block 794 backspin, block 796 normal spin, block 798 topspin or block 800 extreme top spin. The selection of block 700 on the fly mode allows the selection of block 606 or block 802.

Figure 12:
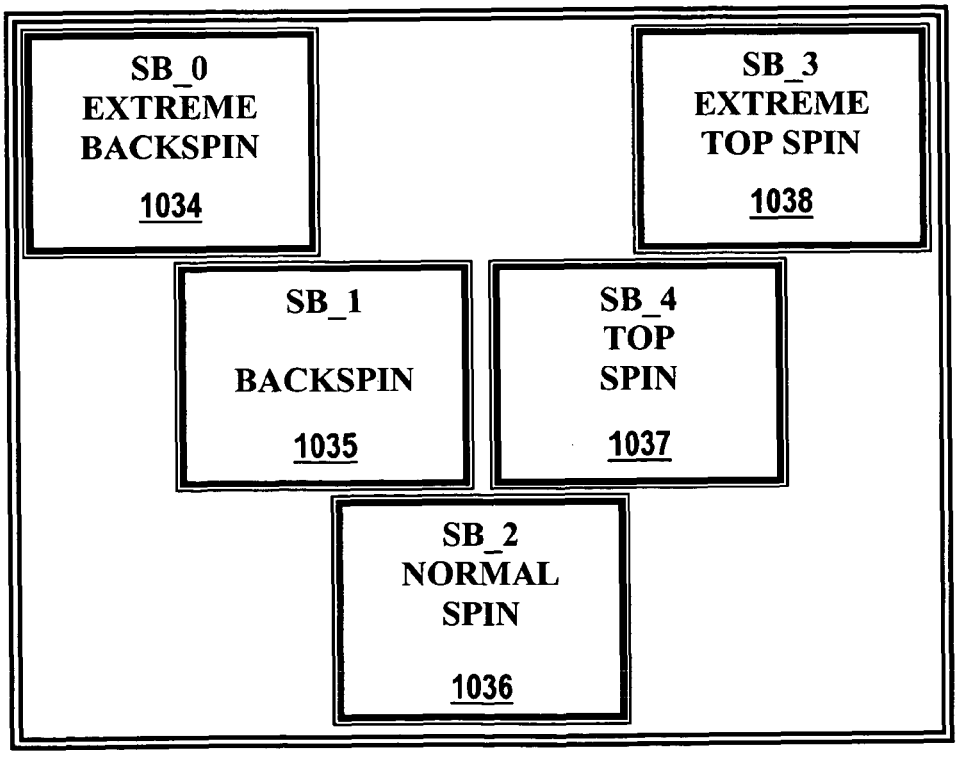
Figure 13:
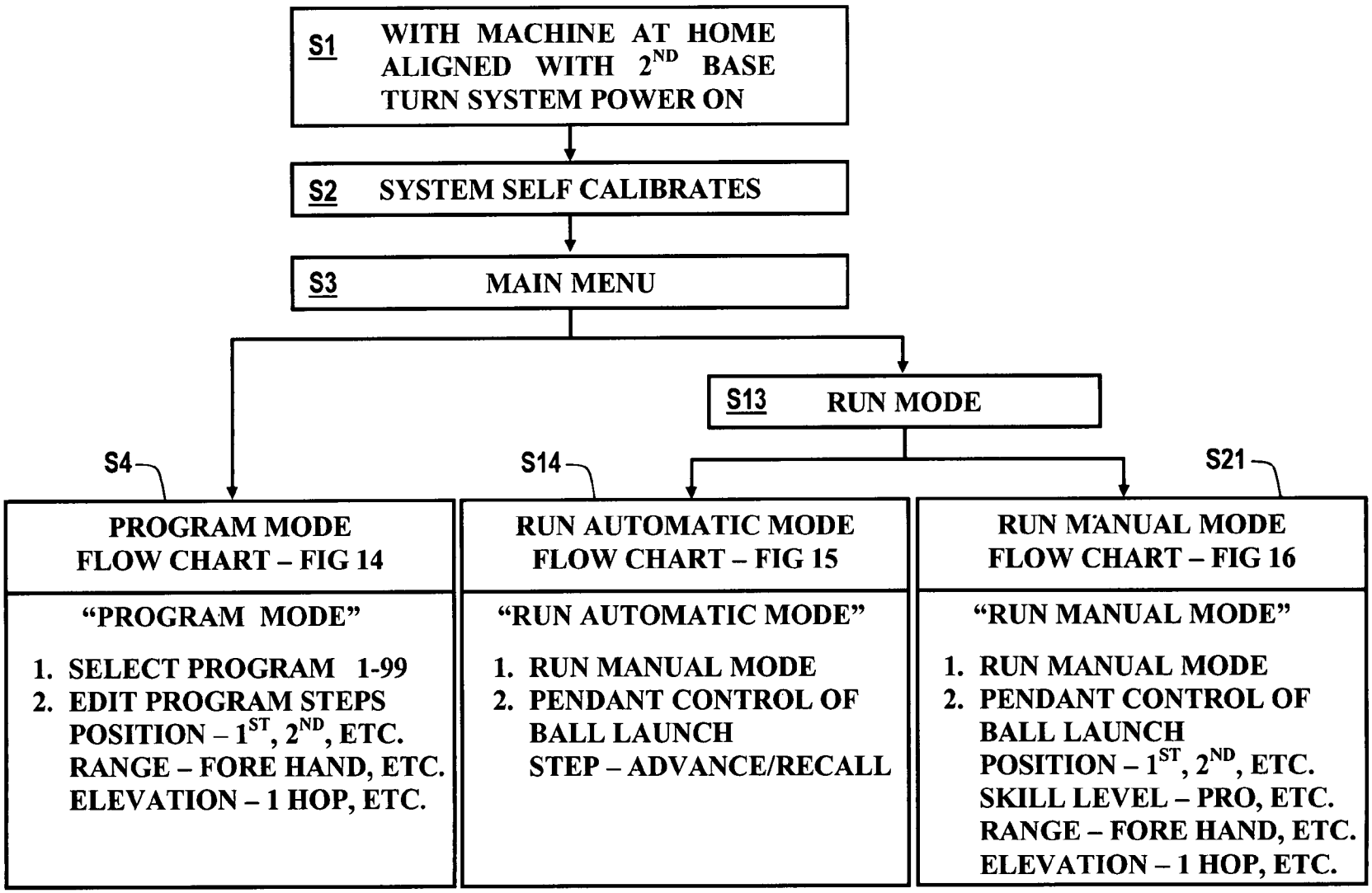
FIG. 13 is a flow diagram illustrating a typical sequence of operational steps.

For example, FIG. 12 is a screen shot of one embodiment of block 790 on a touch screen controller. The activation of area 1034, 1035, 1036, 1037 and 1038 on the controller results in the activation of block 792, 794, 796, 798, and 800 respectively.

Initiation of block 802 initiates block 804 on the fly manual menu. Block 806 is initiated as a result of block 804 and prompts the user to change ball attributes. If the user elects to change the ball attributes then block 808 is initiated, however if the user elects not to change the ball attributes then block 814 is initiated. Block 808 allows the selection of the parameters that control the characteristics of the ball, e.g., spin, type, and range. In the automatic mode, the ball ejection mechanism 22 is operated by the programmable logic controller 90, according to one of multiple programs each having multiple steps. At each step of a particular program, the ball ejection mechanism 22 launches a ball 70 according to the skill level, base or field position, range position, and elevation ball launch characteristics programmed for that step. In each step, the controller 75 is used to launch each ball 70 according to the programmed ball launch characteristics for that step. Block 814 prompts the user to end manual mode. If the user responds positively then block 606 is reinitiated, however if the user responds negatively then block 810 is initiated. Block 810 serves to initiate the firing of the ball and initiation of block 812. Block 812 prompts the user to fire another ball. If the user responds positively to block 812 then block 806 is reinitiated, however a negative response results in block 606 being reactivated.

If block 604 setup was selected from the main menu 602, block 814 is initiated which prompts the user for a password. Block 816 is then initiated which prompts the user to select the level by selecting blocks 820-828, pro block 820, college block 822, high school block 824, junior block 826 and pee-wee block 828. Block 818 is then initiated and the user prompted to set the dimension of the field using blocks 832-840, left field position block 832, the left center field position block 834, the center field position block 836, the right center field position block 838 and the right field position block 840. The user is then prompted to set the time by block 842, followed by initiation of block 644, which prompts the user to return to the main menu. If the user responds positively to block 644, then block 606 is reinitiated, however it the user responds negatively block 604 is reinitiated.

Referring next to FIGS. 13-16, the programmable ball throwing apparatus 1 is capable of being operated in an automatic mode or a manual mode, as hereinafter described. As illustrated in step S1 of FIG. 13, the apparatus 1 is initially placed at home plate on a baseball or softball field, with the ball ejection mechanism 22 aimed toward second base, and then turned on, typically by actuation of a power switch (not shown) which may be provided on the control box 7. As indicated in step S2, by operation of the positioning unit 97, the apparatus 1 self-calibrates such that the ball ejection mechanism 22 is positioned in the direct hit (0) position at second base. Next, from the main menu S3, the apparatus 1 can be operated in the program mode S4 or the run mode S13, as hereinafter described, using the program mode selector switch 94 and the run mode selector switch 95. The program mode S4 is used to select a desired ball launch program by which to operate the apparatus 1, as well as to edit the ball launch characteristics of one or more steps in the selected program. The run mode S13 is used to operate the apparatus 1 in either the automatic mode or the manual mode.

Figure 14:
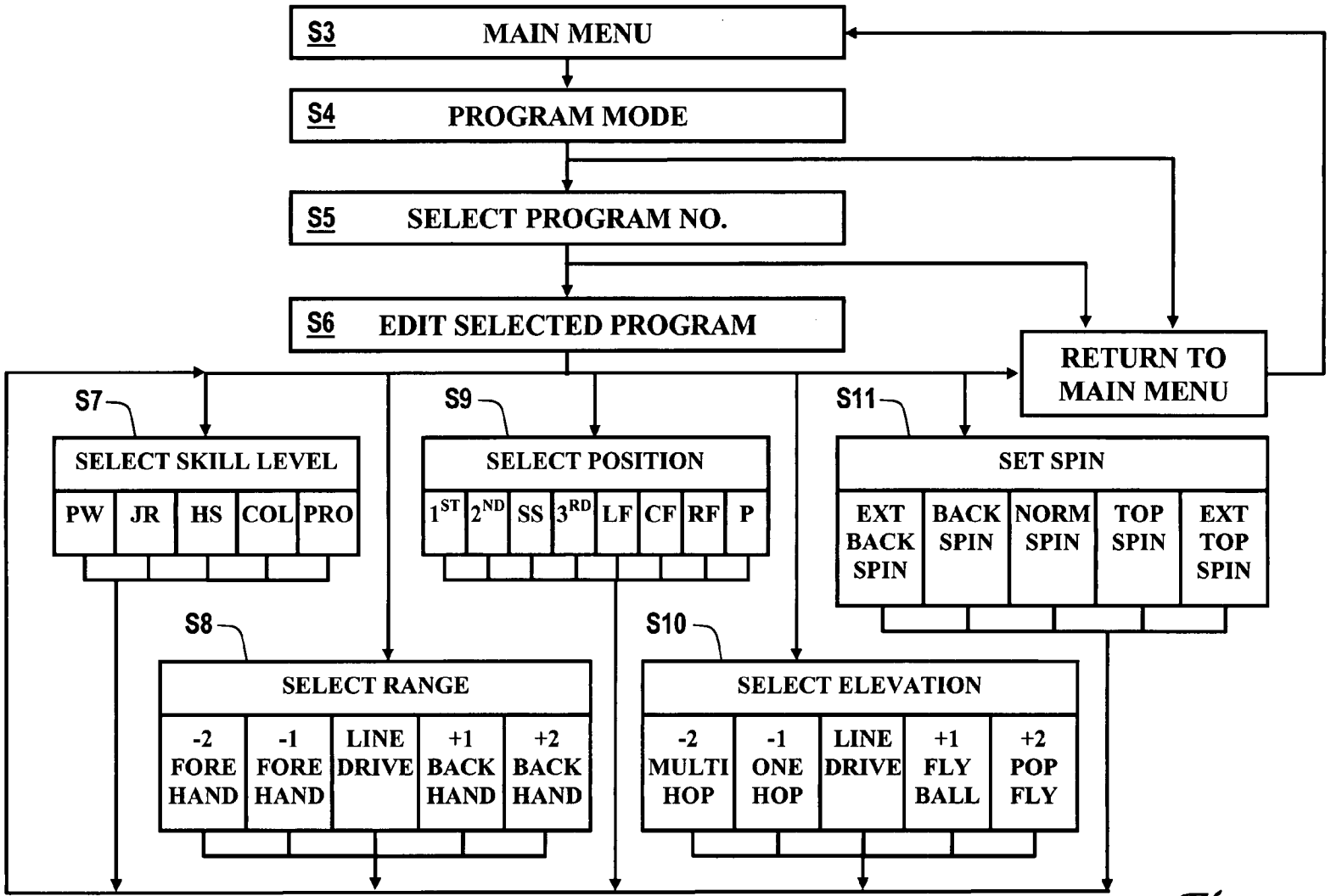
FIG. 14 is a flow diagram illustrating a typical sequence of operational steps for the program mode.
Figure 15:
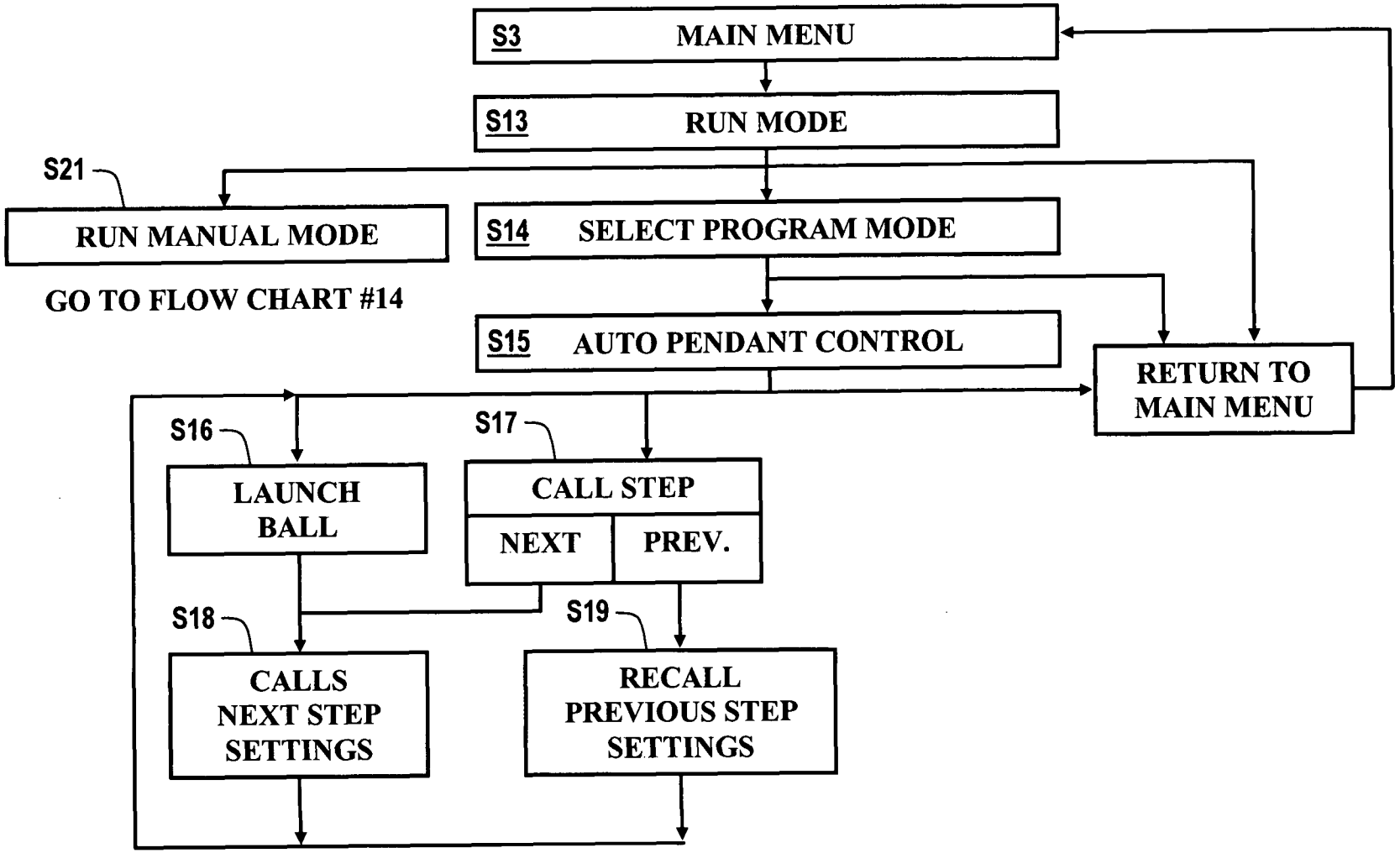
FIG. 15 is a flow diagram illustrating a typical sequence of operational steps for the run automatic mode.

As illustrated in FIG. 14, the program mode S4 is selected by turning the program mode selector switch 94 to the "program" (P) position on the control panel 92, with the run mode selector switch 95 typically turned to the "off" (O) position. Accordingly, as the program mode selector switch 94 remains at the "P" position, the first of multiple, typically 99, programs that are programmed into the logic controller 90 is initially indicated by the numeral "1" in the digital display 93. The programs vary from each other according to the multiple steps (typically 10) each contains, and the steps in a given program vary according to the ball launch characteristics of each step. Typically, one or multiple programs are selected by a baseball or softball coach to train a baseball or softball team during one practice session. As indicated in step S5 of FIG. 14, the desired program to be used is selected by pressing the "up" selector button 93*a* and/or the "down" selector button 93*b* on the control panel 92, and the program numbers of the scrolled programs successively appear in the digital display 93. When the desired program to be used has been selected, as indicated by program number in the digital display 93, the program mode selector switch 94 may then be turned to the "edit" setting (E) on the control panel 92 to edit a step or steps in the selected program, as indicated in step S6 of FIG. 14.

The steps of the program selected in step S6 are indicated by number in the digital display 93, and the step or steps to be edited are individually selected by scrolling the steps, by number, using the "up" selector button 93*a* and/or the "down" selector button 93*b*. When the number of the desired step appears in the digital display 93, the ball launch characteristics of that step can be edited, as desired and as indicated in steps S7-S11 of FIG. 14. For example, the skill level S7 for the step is selected by pushing the "PRO" skill level button 110, "COL" skill level button 111, "HS" skill level button 112, "JR" skill level button 113 or "PW" skill level button 114 on the control panel 92 to operate the apparatus 1 at the selected skill level at that step. The pressed button is illuminated to indicate the skill level for the step. For example, if the "PRO" skill level button 110 is pressed for a particular step in a program, then the "PRO" skill level button 110 is illuminated and remains illuminated as long as the digital display 93 displays the number of that step. This selected skill level for that particular step is automatically saved in the memory of the programmable controller 90.

The range position for the selected step, as indicated in step S8, is programmed by pressing the right range button 119 and/or the left range button 120 on the control panel 92. Since the apparatus 1 is calibrated to initially position the ball ejection mechanism 22 at the direct hit (0) position at second base, the right range button 119 is pressed once (and is continuously illuminated) to select the right (+1) backhand position and twice (and flashes) to select the far right (+2) backhand position. The left range button 120 is pressed once (and is continuously illuminated) to select the left (−1) forehand position and twice (and flashes) to select the far left (−2) forehand position. The selected range position for the step is automatically saved in the memory of the programmable controller 90.

The base or field position of the selected step, as indicated in step S9, is programmed by pressing the first base position button 105, the second base position button 106, the short stop position button 107, the third base position button 108, the left field position button 101, the center field position button 102 or the right field position button 103 on the control panel 92. When the desired position button 105, 106, 107, 108 or field position button 101, 102 or 103 is pressed, that button is illuminated and remains illuminated to indicate the base or field position selected for that step. The selected skill level for the step can be saved in the memory of the programmable controller 90.

The elevation position of the selected step, as indicated in step S10, is programmed by pressing the "up" elevation button 116 and/or the "down" elevation button 117 on the control panel 92. From the line drive (LD) position of the ball ejection mechanism 22, the "up" elevation button 116 is pressed once (and is continuously illuminated) to select the upper (+1) or "fly ball" elevation position and twice (and flashes) to select the uppermost (+2) or "pop fly" elevation position. The "down" elevation button 117 is pressed once (and is continuously illuminated) to select the lower (−1) or "one-hop" elevation position and twice (and flashes) to select the lowermost (−2) or "multi-hop" elevation position. The selected skill level for the step is automatically saved in the memory of the programmable controller 90.

The ball spin may be selected, as indicated in step S11, is programmed by selecting the desired ball spin from the menu including extreme back spin, back spin, normal, top spin or extreme topspin. The selected ball spin for the step can be saved in the memory of the programmable controller 90.

After the skill level, range position, base or field position and elevation position have been selected for a particular step in a program, as indicated in steps S7-S11 and heretofore described, the next or previous step in the program to be edited can be selected by pressing the "up" selector button 93*a* and/or the "down" selector button 93*b* on the control panel 92. That step is then edited in similar fashion. After all of the steps for the program or programs to be used in a practice session have been edited as desired, and the ball launch characteristics for each step of each program saved into the memory of the logic controller 90, the program mode selector switch 94 is turned to the "run" (R) setting on the control panel 92 to operate the apparatus 1 in either the automatic mode or the manual mode, as hereinafter described. The ball launch characteristics programmed into the logic controller 90 for each step of a given program remain unchanged unless and until the ball launch characteristics are subsequently edited in the manner heretofore described with respect to steps S7-S11 of FIG. 14.

The apparatus 1 is operated in the automatic mode, as indicated in step S14, by turning the program mode selector switch 94 to the "run" (R) setting and the run mode selector switch 95 to the "automatic" (A) setting on the control panel 92. Next, as indicated in step S15 of FIG. 15, the controller 75 is used to launch each ball 70 from the ball ejection mechanism 22, as indicated in step S16. This is accomplished by depression of the launch button 77 on the pendant controller 75. Accordingly, the ball ejection mechanism 22 ejects each ball 70 according to the ball launch characteristics of each step in the program previously selected using the program mode selector switch 94 and the "up" selector button 93*a* and/or the "down" selector button 93*b*.

Beginning with the first step in the selected program, the ball ejection mechanism 22 successively ejects balls 70 according to the ball launch characteristics programmed into the logic controller 90 for the respective steps of the program, by successive pressing of the launch button 77. The ball 70 launched at a given step in the program has the combination of ball launch characteristics previously programmed for that step. These ball launch characteristics include the skill level; the base or field position, which corresponds to which of the left field, center field or right field fielding position, or which of the first base, second base, short stop or third base fielding position, the ball 70 is launched toward; the range position; and the elevation position. For example, at a given step in the program, the ball ejection mechanism 22 may launch a ball 70 toward a fielder standing at the center field fielding position. The other launch characteristics of the ball 70 may include a high school (HS) skill level; a back hand (+1) range position; and a fly ball (+1) elevation position. Accordingly, the center field fielder attempts to catch the ball 70 after the ball is launched from the ball ejection mechanism 22. The next ball 70 launched from the ball ejection mechanism 22 at a subsequent step in the program may have the same or different ball launch characteristics for the same or a different fielder, depending on the particular ball launch characteristics of the ball 70 programmed for that particular step in the program. Accordingly, the ball launch characteristics of the balls 70 launched in a particular program can be edited to provide the desired workout for any and all fielding positions in the baseball or softball outfield.

After a ball 70 is ejected from the ball ejection mechanism 22 according to the ball launch characteristics of the first step, for example, the logic controller 90 automatically selects the ball launch characteristics of the second step in the program, as indicated in step S18, and launches the next ball 70 accordingly, until each step in the program has been completed. The ball launch characteristics of the previous step in the program may be selected, as desired, as indicated in step S19, by pressing the "down" selector button 93*b* on the control panel 92. As indicated in step S17, therefore, the ball launch characteristics of the next step in the program are selected and implemented in the next launching of the ball from the ball ejection mechanism 22 by simply pressing the launch button 77 on the pendant controller 75. Conversely, the ball launch characteristics of a previous step in the program are selected by pressing the "down" selector button 93*b* on the control panel 92, and then implemented by pressing the launch button 77 on the pendant controller 75.

Figure 16:
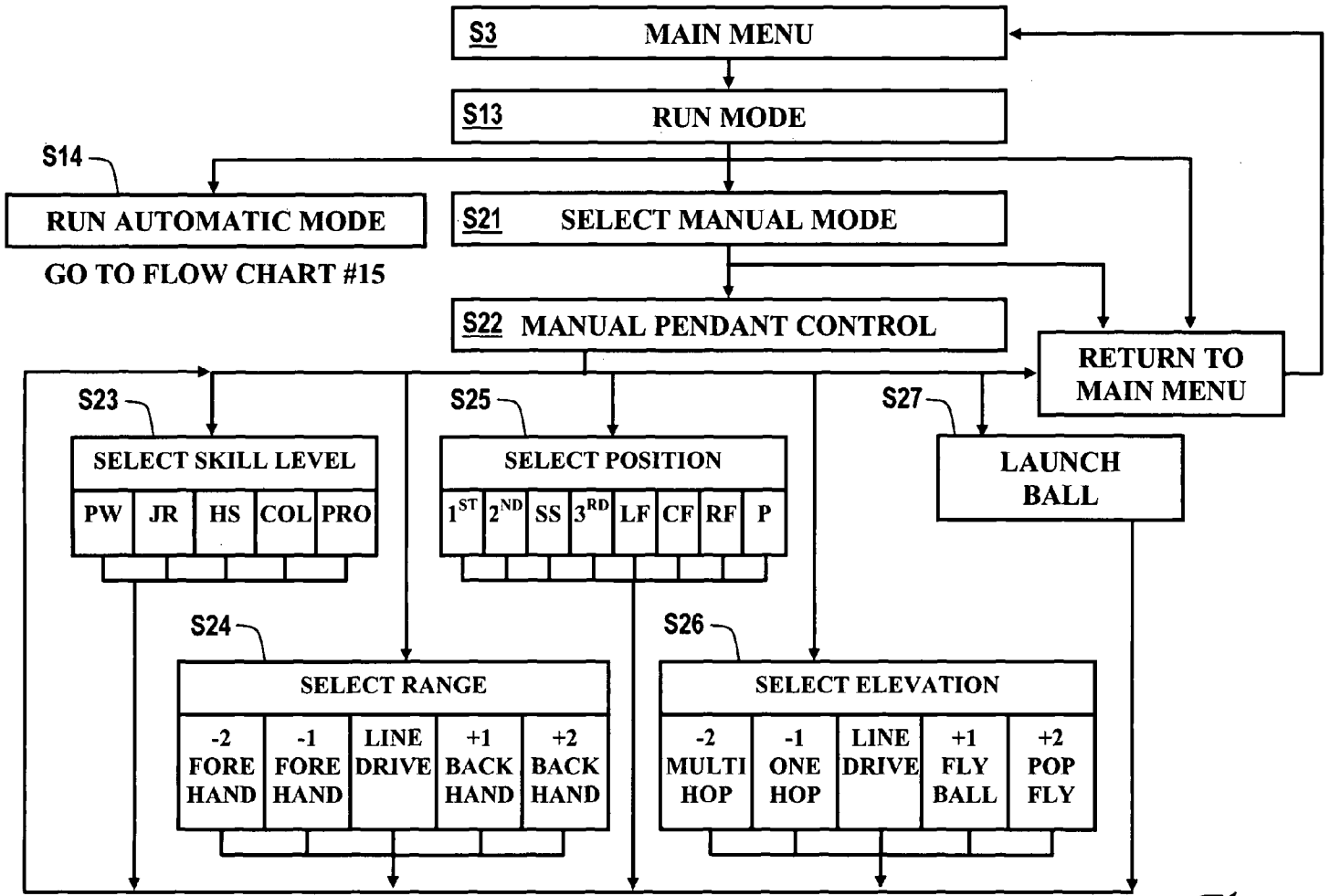
FIG. 16 is a flow diagram illustrating a typical sequence of operational steps for a run manual mode.

As illustrated in FIG. 16, the apparatus 1 is operated in the manual mode, as indicated in step S21, by turning the run mode selector switch 95 to the "manual" (M) setting on the control panel 92 while the program mode selector switch 94 remains at the "run" (R) setting. The ball ejection mechanism 22 is then manually operated using the pendant controller 75, as indicated in step S22. Accordingly, the skill level for a particular ball launch step, indicated in step S23, is selected by pressing a selected one of the skill level buttons 110-114 on the control panel 92. The range position for the step, indicated in step S24, is selected by pressing the right range button 87 or left range button 88. From the direct hit (0) position the right range button 87 is pressed once to select the right (+1) backhand position and twice to select the far right (+2) backhand position. The left range button 88 is pressed once to select the left (−1) forehand position and twice to select the far left (−2) forehand position.

The base or field position for the ball launch step, indicated in step S25, is selected by pressing a selected one of the left field position button 78, center field position button 79, right field position button 80, first base position button 81, second base position button 82, short-stop position button 83 or third base position button 84 on the pendant controller 75. As indicated in step S26, the elevation position for the ball launch step is selected to choose a multi-hop, one-hop, line drive, fly ball or pop fly ball trajectory for the ball launch step. From the line drive (LD) position, the upper (+1) "fly ball" position is selected by pressing the "up" elevation button 85 once. The "up" elevation button 85 is pressed twice to select the uppermost (+2) "pop fly" position. The lower (−1) "one-hop" position is selected by pressing the "down" elevation button 86, whereas the "down" elevation button 86 is pressed twice to select the lowermost (−2) "multi-hop" position. Finally, after the skill level, range position, base or field position and elevation position have been selected, as indicated in steps S23-S26, a ball 70 is launched from the ball ejection mechanism 22 according to the selected ball launch characteristics, as indicated in step S27, by pressing the launch button 77 on the pendant controller 75. Another ball 70 having the same ball launch characteristics can then be launched from the ball ejection mechanism 22 by again pressing the launch button 77. Alternatively, the ball launch characteristics can be changed, according to any or all of steps S23-S26, to launch a ball or balls 70 having the manually-selected ball launch characteristics.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

What is claimed is:

1. A programmable directional ball throwing apparatus comprising:

a frame connected to a hollow rotatable support mast, wherein the hollow rotatable support mast comprises a fixed position hollow mast segment, a rotatable support mast segment in communication with the fixed position hollow mast segment;

a ball passage passing through the fixed position hollow mast segment to the rotatable support mast segment to connect an inlet aperture and an outlet aperture that can rotate without inhibiting ball transport through the passage;

a rotation mechanism comprising a rotation motor operably connected to rotate the hollow support mast, wherein the fixed position hollow support mast is stationary and the rotatable hollow support mast segment is rotated by the rotation motor;

a ball ejection mechanism connected pivotably about the outlet aperture, wherein a ball fed into the inlet aperture tranverses the ball passage to the outlet aperture and into the ball ejection mechanism;

a pivot motor connected operably to the ball ejection mechanism and the hollow support mast; and a computer readable medium embodying a computer program for controlling a three dimensional flight and trajectory parameters of the ball comprising:

a first code segment for receiving one or more parameters identifying a flight and a trajectory of the ball in three dimensions for one or more player positions;

a rotation motor code segment to control the rotation motor to rotate the rotatable hollow support mast segment;

a pivot motor code segment to control the pivot motor to pivot the ball ejection mechanism; and a second code segment for controlling one or more motors to eject the ball in accordance with the received one or more parameters identifying the flight and the trajectory of the ball in three dimensions.

2. The apparatus of claim 1, further comprising a control unit that controls the rotation mechanism, the pivot motor, ball ejection mechanism or combination thereof, to produce various speeds, pivot angles and rotational angles of the ball ejection mechanism.

3. The apparatus of claim 1, wherein the ball passage has a cross section in the shape of an oval, a circle, a square, a rectangle, a polygon, a triangle or combination thereof.

4. The apparatus of claim 1, wherein the hollow support mast comprises a metal, an alloy, a composition, a fiber, a plastic, or combination thereof.

5. The apparatus of claim 1, wherein the ball ejection mechanism and the rotation mechanism are controlled remotely.

6. The apparatus of claim 1, wherein the ball ejection mechanism comprises a pivot mount connected pivotably about the outlet aperture;

a pivot motor connected operably to the pivot mount and the hollow support mast;

a first wheel and a second wheel positioned on the pivot mount about the outlet aperture, wherein a ball fed through the outlet aperture contacts the first wheel and the second wheel; and one or more ejection motors connected operably to the first wheel, the second wheel or both the first wheel and the second wheel.

7. The apparatus of claim 6, wherein the one or more ejection motors, the rotation motor, the pivot motor and combinations thereof are controlled remotely.

8. The apparatus of claim 6, further comprising a processor that controls remotely the one or more ejection motors, the rotation motor, the pivot motor and combinations thereof.

9. The apparatus of claim 1, further comprising a control device that uses one or more parameters stored on a computer readable medium to control the ball ejection mechanism, the rotation mechanism or a combination thereof.

10. The apparatus of claim 1, further comprising a ball feed motor to feed one or more balls into the inlet aperture to transverse the ball passage to the outlet aperture and into the ball ejection mechanism.

11. A fielding practice ball throwing apparatus comprising:

a housing supported by one or more wheels;

a ball holding container positioned about the housing;

a hollow support mast comprising an inlet aperture connected to the ball holding container and a ball passage connected to an outlet aperture;

a rotation mechanism connected to the hollow support mast comprising a rotation motor to rotate the hollow support mast, while the ball passage is maintained during rotation;

a ball ejection mechanism positioned to receive the outlet aperture, wherein the ball ejection mechanism comprises a first wheel and a second wheel attached to a mounting plate and positioned about the outlet aperture, one or more motors connected operably to the first wheel, the second wheel or both the first wheel and the second wheel, wherein a ball is fed into the inlet aperture to transverse the ball passage to the outlet aperture and contacts the first wheel and the second wheel to eject the ball;

a pivot mechanism connected pivotably to the hollow support mast and the ball ejection mechanism, wherein the pivot mechanism comprises a pivot motor operably connected to tilt the ball ejection mechanism while the ball passage is maintained;

a control unit in electrical communication with the rotation mechanism, the pivot mechanism and the ball ejection mechanism to control the pivot angle, the rotational angle, and the flight parameters of the ball a rotation motor code segment in a computer readable media in contact with the control unit to control the rotation motor to rotate the rotatable hollow support mast segment; and a pivot motor code segment in a computer readable media in contact with the control unit to control the pivot motor to pivot the ball ejection mechanism.

12. The apparatus of claim 11, wherein the hollow support mast further comprising a fixed position hollow support mast segment in communication with a rotatable hollow support mast segment, wherein the fixed position hollow support mast is stationary and the rotatable hollow support mast segment is rotated by the rotation mechanism.

13. The apparatus of claim 11, wherein the rotational motor is connected operably to the housing and the hollow support mast.

14. The apparatus of claim 11, wherein the pivot motor is connected operably to the ball ejection mechanism and the hollow support mast.

15. The apparatus of claim 11, wherein the control unit comprising a processor that controls the ball ejection mechanism, the rotation mechanism the pivot mechanism or combination thereof.

16. The apparatus of claim 15, wherein the processor is in wireless communication with a handheld device.

17. The apparatus of claim 16, further comprising one or more processors that controls the ball ejection mechanism, the rotation mechanism the pivot mechanism or combination thereof, whereby the apparatus may eject one or more balls to specific locations and in a specific order for fielding practice.

18. An automatic directional ball throwing fungo apparatus comprising:

a frame connected to a hollow rotatable support mast, wherein the hollow rotatable support mast comprises:

a fixed position hollow mast segment, a rotatable support mast segment in communication with the fixed position hollow mast segment;

a ball passage passing through the fixed position hollow mast segment to the rotatable support mast segment to connect an inlet aperture and an outlet aperture that can rotate without inhibiting ball transport through the passage;

a rotation mechanism comprising a rotation motor operably connected to rotate the hollow support mast, wherein the fixed position hollow support mast is stationary and the rotatable hollow support mast segment is rotated by the rotation motor;

a ball ejection mechanism connected pivotably about the outlet aperture, wherein a ball fed into the inlet aperture tranverses the ball passage to the outlet aperture and into the ball ejection mechanism;

a pivot motor connected operably to the ball ejection mechanism and the hollow support mast;

a control unit in electrical communication with the rotation mechanism, the pivot mechanism and the ball ejection mechanism to control the pivot angle, the rotational angle, and the flight parameters of the ball;

a rotation motor code segment in a computer readable media in contact with the control unit to control the rotation motor to rotate the rotatable hollow support mast segment; and a pivot motor code segment in a computer readable media in contact with the control unit to control the pivot motor to pivot the ball ejection mechanism.

19. The apparatus of claim 1, wherein the computer program controls the programmable directional ball throwing apparatus.

20. The apparatus of claim 1, wherein an user defines one or more of the following: the one or more parameters identifying the flight and the trajectory correspond generally to an area on the field; one or more parameters identifying the flight and the trajectory control a range of travel for the ball within the one or more player positions; one or more parameters identifying the flight and the trajectory designate a groundball, a line drive, a fly ball or combinations thereof one or more parameters identifying the flight and the trajectory control a ball speed; and one or more parameters identifying the flight and the trajectory control a ball spin.

21. The apparatus of claim 20, wherein the area on the field is a pitcher's mound, a home plate, a first base, a second base, a short stop, a third base, a left field, a right field, a centerfield or combinations thereof.

* * * * *